US008675901B2

(12) United States Patent
Kojima et al.

(10) Patent No.: US 8,675,901 B2
(45) Date of Patent: Mar. 18, 2014

(54) HOWLING SUPPRESSION DEVICE, HEARING AID, HOWLING SUPPRESSION METHOD, AND INTEGRATED CIRCUIT

(75) Inventors: Mariko Kojima, Osaka (JP); Takefumi Ura, Ehime (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/993,342

(22) PCT Filed: Jul. 30, 2012

(86) PCT No.: PCT/JP2012/004832
§ 371 (c)(1),
(2), (4) Date: Jun. 12, 2013

(87) PCT Pub. No.: WO2013/054458
PCT Pub. Date: Apr. 18, 2013

(65) Prior Publication Data

US 2013/0259277 A1 Oct. 3, 2013

(30) Foreign Application Priority Data

Oct. 14, 2011 (JP) ..... 2011-226438

(51) Int. Cl.
*H04R 25/00* (2006.01)
*G10K 11/16* (2006.01)

(52) U.S. Cl.
USPC ..... 381/317; 381/71.11

(58) Field of Classification Search
None
See application file for complete search history.

(56) References Cited

U.S. PATENT DOCUMENTS

| | | | |
|---|---|---|---|
| 7,974,428 | B2 | 7/2011 | Klinkby et al. |
| 2006/0140429 | A1 | 6/2006 | Klinkby et al. |
| 2009/0067651 | A1 | 3/2009 | Klinkby et al. |
| 2010/0329474 | A1 | 12/2010 | Ura |

FOREIGN PATENT DOCUMENTS

| | | |
|---|---|---|
| JP | 04-081133 | 3/1992 |
| JP | 05-308697 | 11/1993 |
| JP | 2002-076999 | 3/2002 |
| JP | 2007-515820 | 6/2007 |
| JP | 2009-532924 | 9/2009 |
| WO | 2005/020632 | 3/2005 |
| WO | 2007/113282 | 10/2007 |
| WO | 2010/087147 | 8/2010 |

OTHER PUBLICATIONS

International Search Report issued Nov. 6, 2012 in International (PCT) Application No. PCT/JP2012/004832.

*Primary Examiner* — Brian Ensey
*Assistant Examiner* — Norman Yu
(74) *Attorney, Agent, or Firm* — Wenderoth, Lind & Ponack, L.L.P.

(57) ABSTRACT

A howling suppression device includes: a subtractor which generates an error signal; an adaptive filter which applies filtering to the error signal; and a coefficient update control unit which controls an update rate of a filter coefficient and includes: a convergence analysis unit which determines whether or not a condition that the degree of convergence of filter characteristics is higher than a criterion value is satisfied; a change amount analysis unit which determines whether or not a condition that the degree of convergence has turned out to be higher is satisfied; and an update rate control unit which sets the update rate to a first rate when both the conditions are satisfied and to a second rate when at least one of the conditions is not satisfied. The adaptive filter updates the filter coefficient at the update rate.

12 Claims, 15 Drawing Sheets

HOWLING SUPPRESSION DEVICE, HEARING AID, HOWLING SUPPRESSION METHOD, AND INTEGRATED CIRCUIT

TECHNICAL FIELD

The present invention relates to a howling suppression device which automatically detects and suppresses a howling sound generated by sound coupling between a speaker and a microphone included in a sound apparatus.

BACKGROUND ART

Howling is an oscillation phenomenon caused by a sound loop in which a sound outputted from a speaker returns to a microphone. Once a sound loop is formed, a sinusoidal signal having a sharp peak is generated and a sound having a particular frequency continues to be amplified until the loop is cut.

As a conventional howling suppression device, there is proposed one which estimates spatial transfer characteristics between a microphone and a speaker by adaptive processing using an adaptive filter, and cuts a sound loop by subtracting a pseudo feedback signal generated by the adaptive filter from an input signal, thereby suppressing a howling sound (see Patent Literature (PTL) 1 for an example).

CITATION LIST

Patent Literature

[PTL 1]
Japanese Unexamined Patent Application Publication (Transition of PCT Application) No. 2009-532924

SUMMARY OF INVENTION

Technical Problem

However, such a conventional howling suppression device has a problem that the estimation performance of the spatial transfer characteristics of the adaptive filter may decline, or sound quality of a processed sound may be degraded for reasons such as erroneous detection of howling components included in a sound picked up by a microphone.

The present invention has its object to provide a howling suppression device which has increased accuracy in detection of howling caused by audio feedback, and adaptively suppresses the howling, thereby solving the problem of the conventional art.

Solution to Problem

A howling suppression device according to an aspect of the present invention reduces a howling component included in an input signal. More specifically, the howling suppression device includes: a subtractor which generates an error signal by subtracting, from the input signal, a pseudo feedback signal which is an estimated signal of a feedback signal that is the howling component included in the input signal; an adaptive filter which generates a pseudo feedback signal for a next input signal by applying filtering to the error signal; and a coefficient update control unit configured to control an update rate of a filter coefficient of the adaptive filter. The coefficient update control unit includes: a convergence analysis unit configured to determine whether or not a first condition that the degree of convergence of filter characteristics of the adaptive filter with respect to spatial transfer characteristics is higher than a criterion value is satisfied, the filter characteristics being determined by the filter coefficient; a change amount analysis unit configured to determine whether or not a second condition that the degree of convergence of the filter characteristics with respect to the spatial transfer characteristics has turned out to be higher than a predetermined period of time before is satisfied; and an update rate control unit configured to set the update rate to a first rate when both the first condition and the second condition are satisfied, and set the update rate to a second rate when at least one of the first condition or the second condition is not satisfied, the second rate being lower than the first rate. The adaptive filter updates the filter coefficient for the application of the filtering to the error signal at the update rate set by the update rate control unit.

It should be noted that these general or specific aspects can be implemented as a system, a method, an integrated circuit, a computer program, a recording medium, or any combination of a system, a method, an integrated circuit, a computer program, and a recording medium.

Advantageous Effects of Invention

According to the present invention, it is possible to increase accuracy in detection of howling caused by audio feedback, and adaptively suppress the howling.

DESCRIPTION OF EMBODIMENTS (Underlying Knowledge Forming Basis of the Present Disclosure)

Figure 17:
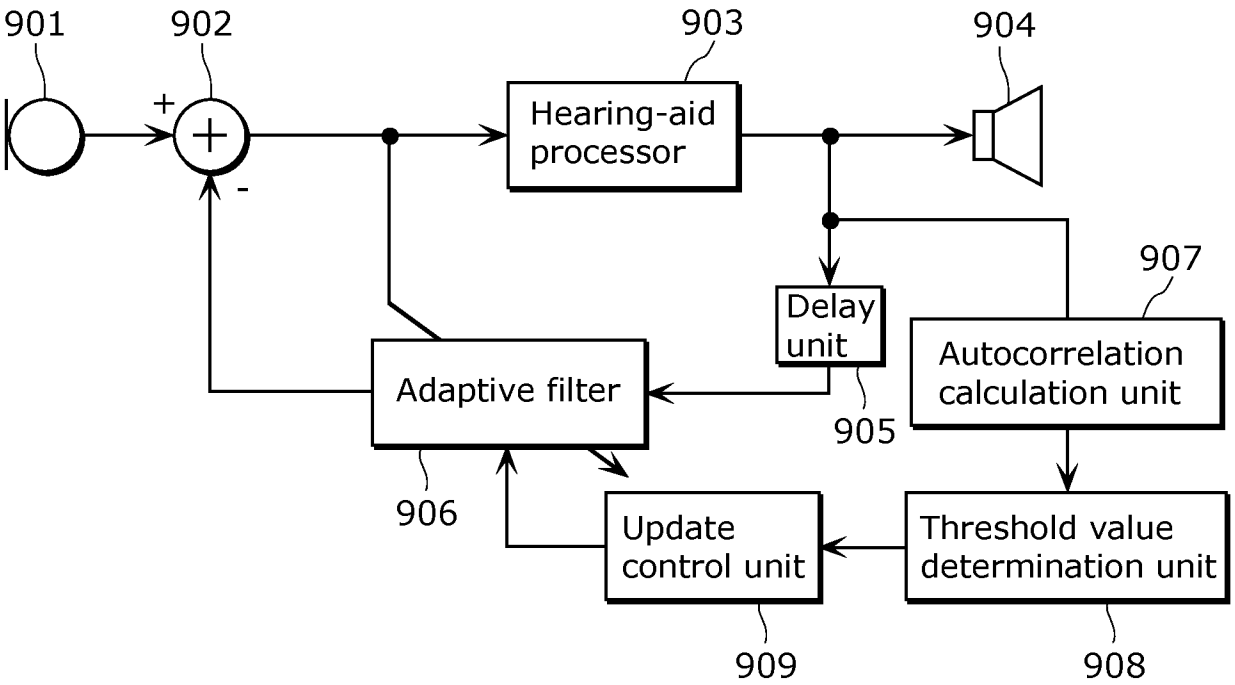
FIG. 17 is a basic block diagram of the howling suppression device described in PTL 1.

FIG. 17 is a block diagram illustrating a configuration of the howling suppression device described in PTL 1.

In FIG. 17, the howling suppression device includes: a microphone 901 which converts an input sound into an input signal; a subtractor 902 which subtracts an output signal of an adaptive filter 906 from the input signal of the microphone 901 to output an error signal; a hearing-aid processor 903 which generates a processor output signal by applying an amplification gain to the error signal; a speaker 904 which converts the output signal of the hearing-aid processor 903 into an output sound; a delay unit 905 which delays the output signal of the hearing-aid processor 903; the adaptive filter 906 which adaptively derives an adaptive filter output signal (a pseudo feedback signal) by applying a filter coefficient to an output signal of the delay unit 905; an autocorrelation calculation unit 907 which calculates an autocorrelation of the output signal of the hearing-aid processor 903; a threshold value evaluation unit 908 which evaluates the value of autocorrelation calculated by the autocorrelation calculation unit 907 based on a threshold value to determine a change of adaptation rate; and an update control unit 909 which determines an update rate of the adaptive filter 906 from the evaluation result of the threshold value evaluation unit 908.

The signal inputted from the microphone 901 passes through the hearing-aid processor 903 to be amplified and is outputted from the speaker 904. At this time, part of the output signal of the speaker 904 is inputted again to the microphone 901 as a feedback signal. Then, the loop of a sound is maintained and the sound is repeatedly amplified in the hearing-aid processor 903, so that howling, which is an oscillation phenomenon of signal, occurs. Accordingly, by causing the adaptive filter 906 to estimate the spatial transfer characteristics between the speaker 904 and the microphone 901 to generate a pseudo feedback signal which is an estimated feedback signal to which the howling is attributed, and subtracting the estimated pseudo feedback signal from the input signal at the subtractor 902, it is possible to suppress the howling.

A signal of a howling sound is a sine wave having a high autocorrelation. It is known that there is a trade-off between the rate and accuracy of the estimation, that is, the lower the update rate is, the longer estimation of target characteristics takes while the more accurately the target characteristics are estimated, and the higher the update rate is, the more quickly estimation of target characteristics is performed while the less accurately the target characteristics are estimated. Coordinates are usually updated at a rather moderate rate with priority for accuracy in estimation, but when a howling sound is generated, such estimation and suppression of the howling sound need to be performed quickly. To do so, the conventional howling suppression device is configured to control the update rate for the adaptive filter. More specifically, when an output signal of the hearing-aid processor 903 has an autocorrelation that exceeds a predetermined threshold value, the conventional howling suppression device determines that a howling sound is being generated and increases the update rate of the adaptive filter. Filter coefficients of the adaptive filter are thus updated by using autocorrelation values.

However, in the configuration described in PTL 1, the update rate is increased as a result of the updating controlled only based on the level of the autocorrelation of a signal amplified by a hearing-aid processor. Accordingly, adaptation rate may be increased erroneously when a signal having a high autocorrelation indicates not a howling sound but a sound to be heard by the user, such as a siren or a ringtone. However, such a conventional howling suppression device has a problem that the estimation performance of the spatial transfer characteristics of the adaptive filter may decline and a problem that sound quality of a processed sound may be degraded.

In order to solve the problems, provided is a howling suppression device according to an aspect of the present invention reduces a howling component included in an input signal. More specifically, the howling suppression device includes: a subtractor which generates an error signal by subtracting, from the input signal, a pseudo feedback signal which is an estimated signal of a feedback signal that is the howling component included in the input signal; an adaptive filter which generates a pseudo feedback signal for a next input signal by applying filtering to the error signal; and a coefficient update control unit configured to control an update rate of a filter coefficient of the adaptive filter. The coefficient update control unit includes: a convergence analysis unit configured to determine whether or not a first condition that the degree of convergence of filter characteristics of the adaptive filter with respect to spatial transfer characteristics is higher than a criterion value is satisfied, the filter characteristics being determined by the filter coefficient; a change amount analysis unit configured to determine whether or not a second condition that the degree of convergence of the filter characteristics with respect to the spatial transfer characteristics has turned out to be higher than a predetermined period of time before is satisfied; and an update rate control unit configured to set the update rate to a first rate when both the first condition and the second condition are true, and set the update rate to a second rate when at least one of the first condition or the second condition is not satisfied, the second rate being lower than the first rate. The adaptive filter updates the filter coefficient for the application of the filtering to the error signal at the update rate set by the update rate control unit.

In this configuration, howling caused by audio feedback can be detected with increased, and the howling is rapidly suppressed with little degradation of sound which a user wants to hear, by increasing the update rate of the filter coefficient of the adaptive filter only while howling is detected.

Note that "convergence of filter characteristics of an adaptive filter with respect to spatial transfer characteristics" may be expressed as "update of an adaptive filter" in the present description. Also note that an "update rate of a filter coefficient of an adaptive filter" may be expressed as an "update rate of an adaptive filter" in the present description.

Furthermore, the coefficient update control unit may further include: a first level calculation unit configured to calculate a signal level of the input signal; and a second level calculation unit configured to calculate a signal level of the error signal. When mean squared error between the signal level of the input signal and the signal level of the error signal is below a predetermined threshold value, the convergence analysis unit may be configured to determine that the first condition is satisfied.

In this configuration, convergence of the adaptive filter can be observed by performing threshold determining on mean squared error between an input signal and an error signal, so that howling can be detected with increased accuracy.

Furthermore, when mean squared error between the signal level of the input signal and the signal level of the error signal shows a tendency to decrease in the predetermined period of time, the change amount analysis unit may be configured to determine that the second condition is satisfied.

In this configuration, convergence of the adaptive filter can be observed by performing threshold determining on the amount of change in the mean squared error with time, so that howling can be detected with increased accuracy.

Furthermore, when the first condition and the second condition are satisfied, the update rate control unit may be configured to set the first rate at a higher level when the mean squared error between the signal level of the input signal and the signal level of the error signal has a smaller value.

In this configuration, updating of the adaptive filter can be controlled according to an input signal by reflecting the degree of convergence of the adaptive filter on the update rate of the adaptive filter.

Furthermore, the coefficient update control unit may further include: a frequency analysis unit configured to convert the signal level of the input signal into a frequency signal; and a peak detection unit configured to determine whether or not a third condition that the frequency signal has a peak is satisfied. When all the first condition to the third condition are satisfied, the update rate control unit may be configured to set the update rate to the first rate, and when at least one of the first condition, the second condition, or the third condition is not satisfied, the update rate control unit may be configured to set the update rate to the second rate.

In this configuration, information on frequency characteristics of an input signal is taken into consideration in determining whether or not howling is occurring, so that howling can be detected with increased accuracy.

Furthermore, the coefficient update control unit may further include an audio detection unit configured to determine whether or not a fourth condition that the signal level of the input signal has a maximum value above a predetermined value is satisfied. When all the first condition, the second condition, and the fourth condition are satisfied, the update rate control unit may be configured to set the update rate to the first rate, and when at least one of the first condition, the second condition, or the fourth condition is not satisfied, the update rate control unit may be configured to set the update rate to the second rate.

In this configuration, information on the magnitude of an input signal is taken into consideration in determining whether or not howling is occurring, so that howling can be detected with increased accuracy.

Furthermore, when the mean squared error remains below a predetermined threshold value for a predetermined period of time, the convergence analysis unit may be configured to determine that the first condition is satisfied.

In this configuration, temporal continuity of a result of threshold determining performed on the mean squared error can be observed, so that howling can be detected with increased accuracy.

Furthermore, the change amount analysis unit may be configured to determine whether or not the second condition is satisfied, based on analysis of a slope value of the mean squared error plotted against time.

In this configuration, whether or not convergence of the adaptive filter has been stable for a certain period of time can be determined by referring to the slope value of the mean squared error plotted against time, so that howling can be detected with increased accuracy.

Furthermore, the change amount analysis unit may be configured to determine whether or not the second condition is satisfied, based on analysis of a difference between values of the mean squared error plotted against time.

In this configuration, whether or not convergence of the adaptive filter has been stable for a certain period of time can be determined by referring to the difference between the values of the mean squared error plotted against time, so that howling can be detected with increased accuracy.

A hearing aid according to an aspect of the present invention includes: any one of the above-described howling suppression devices; and an output unit configured to convert the error signal generated by the subtractor into an output sound and output the output sound.

In this configuration, a hearing aid in this configuration causes less discomfort due to howling.

A howling suppression method according to an aspect of the present invention is a method for reducing a howling component included in an input signal. Specifically, the howling suppression method includes: generating an error signal by subtracting, from the input signal, a pseudo feedback signal which is an estimated signal of a feedback signal that is the howling component included in the input signal; generating a pseudo feedback signal by applying filtering to the error signal, the generated pseudo feedback signal to be used for a next input signal; and controlling an update rate of a filter coefficient for the generating of a pseudo feedback signal. The controlling includes: determining whether or not a first condition that the degree of convergence of filter characteristics of the adaptive filter with respect to spatial transfer characteristics is higher than a criterion value is satisfied, the filter characteristics being determined by the filter coefficient; determine whether or not a second condition that the degree of convergence of the filter characteristics with respect to the spatial transfer characteristics has turned out to be higher than a predetermined period of time before is satisfied; and setting the update rate to a first rate when both the first condition and the second condition are satisfied, and setting the update rate to a second rate when at least one of the first condition or the second condition is not satisfied, the second rate being lower than the first rate. In the generating of the pseudo feedback signal, the filter coefficient for the application of the filtering to the error signal is updated at the update rate set by the update rate control unit.

An integrated circuit according to an aspect of the present invention reduces a howling component included in an input signal. More specifically, the integrated circuit includes: a subtractor which generates an error signal by subtracting, from the input signal, a pseudo feedback signal which is an estimated signal of a feedback signal that is the howling component included in the input signal; an adaptive filter which generates a pseudo feedback signal for a next input signal by applying filtering to the error signal; and a coefficient update control unit configured to control an update rate of a filter coefficient of the adaptive filter. The coefficient update control unit includes: a convergence analysis unit configured to determine whether or not a first condition that the degree of convergence of filter characteristics of the adaptive filter with respect to spatial transfer characteristics is higher than a criterion value is satisfied, the filter characteristics being determined by the filter coefficient; a change amount analysis unit configured to determine whether or not a second condition that the degree of convergence of the filter characteristics with respect to the spatial transfer characteristics has turned out to be higher than a predetermined period of time before is satisfied; and an update rate control unit configured to set the update rate to a first rate when both the first condition and the second condition are satisfied, and set the update rate to a second rate when at least one of the first condition or the second condition is not satisfied, the second rate being lower than the first rate. The adaptive filter updates the filter coefficient for the application of the filtering to the error signal at the update rate set by the update rate control unit.

It should be noted that these generally or specifically aspects of the present invention can be implemented either as a system, a method, an integrated circuit, a computer program, a recording medium, or any combination of a system, a method, an integrated circuit, a computer program, and a recording medium.

Embodiments of the present invention shall be described below with reference to the drawings. Each of the exemplary embodiments described below shows a specific example of the present invention. The values, materials, constituent elements, layout and connection of the constituent elements, steps, and the order of the steps in the embodiments are given not for limiting the present invention but merely for illustrative purposes only. Therefore, among the structural elements in the following exemplary embodiments, structural elements not recited in any one of the independent claims are described as arbitrary structural elements.

Embodiment 1

A howling suppression device according to Embodiment 1 reduces a howling component included in an input signal and includes at least: a subtractor which generates an error signal by subtracting, from the input signal, a pseudo feedback signal which is an estimated signal of a feedback signal that is the howling component included in the input signal; an adaptive filter which generates a pseudo feedback signal for a next input signal by applying filtering to the error signal; and a coefficient update control unit configured to control an update rate of a filter coefficient of the adaptive filter. The adaptive filter updates the filter coefficient for the application of the filtering to the error signal at the update rate set by the coefficient update control unit (or an update rate control unit described later).

Figure 1:
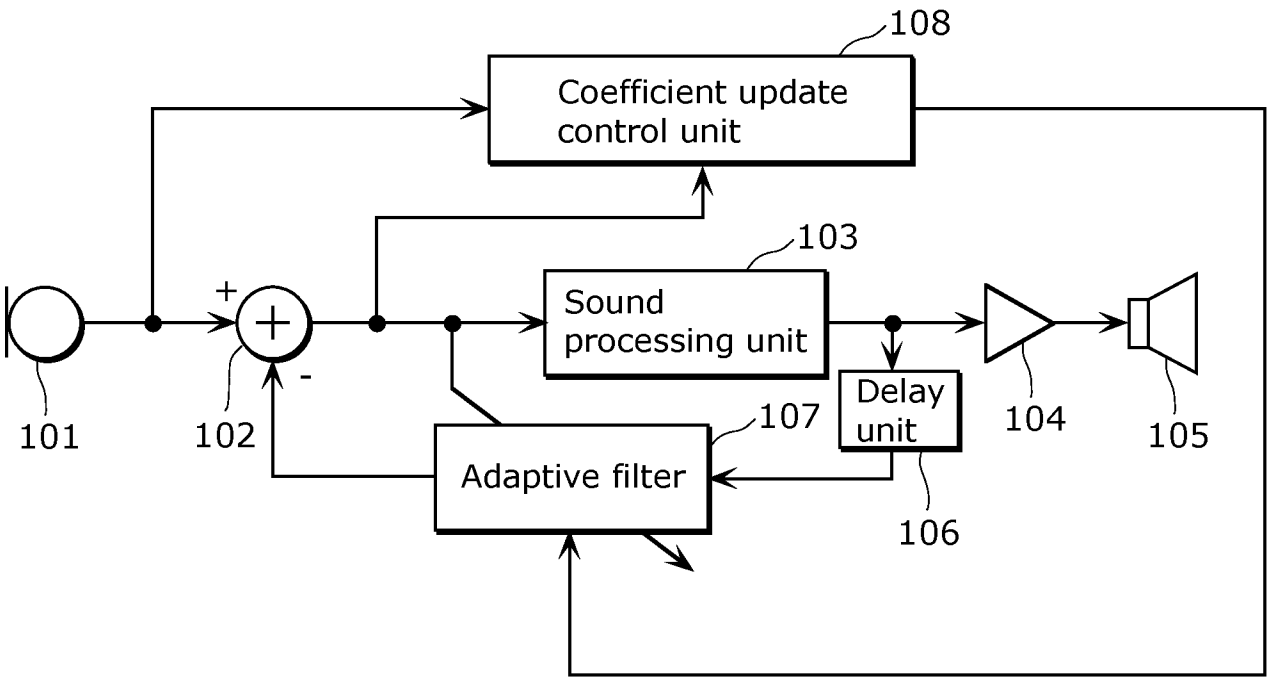
FIG. 1 is a basic block diagram of a howling suppression device in Embodiment 1.

Referring to FIG. 1, the howling suppression device according to Embodiment 1 will be described in detail. FIG. 1 is a basic block diagram of the howling suppression device in Embodiment 1.

In FIG. 1, the howling suppression device according to the present embodiment includes: a microphone 101 which picks up and converts a sound in the surrounding into an input signal (target signal); a subtractor 102 which subtracts an output signal (pseudo feedback signal) of an adaptive filter 107 from the output signal (target signal) of the microphone 101 to output an erroneous signal (error signal); a sound processing unit 103 which applies sound signal processing to an inputted error signal to output the error signal; an amplifier 104 which amplifies an output signal of the sound processing unit 103; a speaker 105 which outputs a sound (output sound) amplified by the amplifier 104; a delay unit 106 which delays the output signal of the sound processing unit 103 to output the output signal as a reference signal of the adaptive filter 107; an adaptive filter 107 which outputs a pseudo feedback signal by convoluting a filter coefficient into the inputted reference signal, and updates the filter coefficient according to an adaptation algorithm; and a coefficient update control unit 108 which determines the update rate of the adaptive filter 107 based on the target signal outputted from the microphone 101 and the error signal outputted from the subtractor 102.

The coefficient update control unit according to Embodiment 1 includes at least: a convergence analysis unit which determines whether or not a first condition that the degree of convergence filter characteristics of the adaptive filter with respect to spatial transfer characteristics is higher than a criterion value is satisfied; a change amount analysis unit which determines whether or not a second condition that the degree of convergence of the filter characteristics with respect to the spatial transfer characteristics has turned out to be higher than a predetermined period of time before is satisfied; and an update rate control unit sets the update rate to a first rate when both the first condition and the second condition are satisfied, and sets the update rate to a second rate which is lower than the first rate when at least one of the first condition or the second condition is not satisfied. The filter characteristics of the adaptive filter are determined by the filter coefficient.

More specifically, the coefficient update control unit further includes a first level calculation unit which calculates the signal level of the input signal and a second level calculation unit which calculates the signal level of the error signal. The convergence analysis unit may determine that the first condition is satisfied when the mean squared error of between the signal level of the input signal and the signal level of the error signal is below a predetermined threshold value. Furthermore, the change amount analysis unit may determine that the second condition is satisfied when the mean squared error of between the signal level of the input signal and the signal level of the error signal shows a tendency to decrease in a predetermined period of time.

Figure 2:
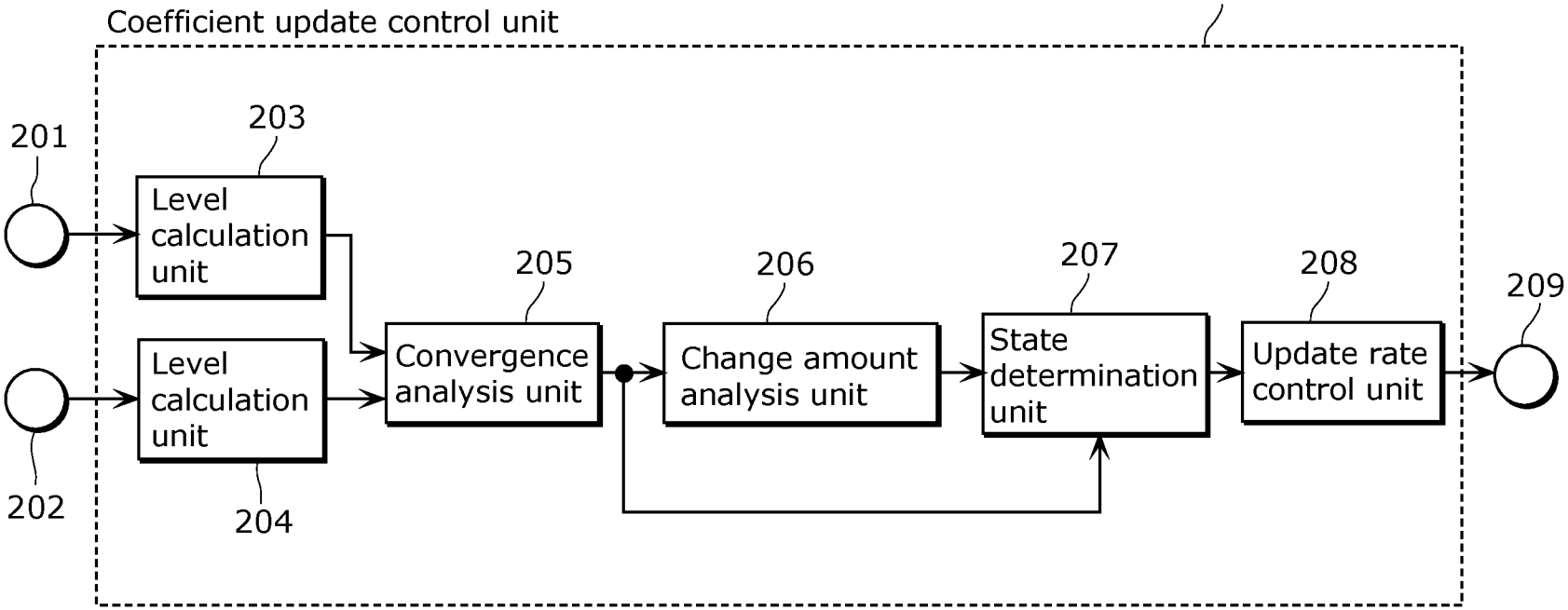
FIG. 2 is a detailed block diagram of a coefficient update control unit of the howling suppression device in Embodiment 1.

Next, referring to FIG. 2, the coefficient update control unit 108 will be described in detail. FIG. 2 is a detailed block diagram of the coefficient update control unit 108 of the howling suppression device in Embodiment 1.

In FIG. 2, the coefficient update control unit 108 according to Embodiment 1 includes: an input terminal 201 to which a target signal is inputted; an input terminal 202 to which an error signal is inputted; a level calculation unit 203 which calculates the signal level of the target signal; a level calculation unit 204 which calculates the signal level of the error signal; a convergence analysis unit 205 which analyzes the degree of convergence of the adaptive filter 107 from the signal level of the target signal and the signal level of the error signal; a change amount analysis unit 206 which analyzes temporal change in an output signal (mean squared error) of the convergence analysis unit 205; a state determination unit 207 which determines whether or not a howling sound is being generated, from the mean squared error outputted from the convergence analysis unit 205 and the slope of the mean squared error outputted from the change amount analysis unit 206, an update rate control unit 208 which determines, from a result of the determination of the state determination unit 207, a parameter to set the update rate of the adaptive filter 107; and an output terminal 209 which outputs the determined parameter for update control.

First, overall operation of the howling suppression device in Embodiment 1 will be described.

The subtractor 102 subtracts an output signal of the adaptive filter 107 from the input signal inputted to the microphone 101 to obtain an error signal, which is inputted to a sound processing unit 103. The sound processing unit 103, which is configured to apply a desired sound signal processing to the inputted error signal, performs processing, for example, amplification and filtering, on the error signal to output a temporal waveform. The output signal of the sound processing unit 103 is inputted to the amplifier 104 whereby the output signal is amplified. Then, the amplified output signal is outputted from the speaker 105 as an output sound. At this time, a sound loop is formed between the speaker 105 and the microphone 101 as a result of feedback of part of the output sound from the speaker to the microphone 101. When the sound loop remains and a signal continues to go around the sound loop, the signal oscillates in a particular frequency band, causing howling. Then, the howling suppression device in Embodiment 1 suppresses the howling by means of the adaptive filter 107.

Moreover, the output signal outputted from the sound processing unit 103 is inputted to the delay unit 106 to be delayed by, for example, several to several tens of samples. The output signal delayed by the delay unit 106 is outputted to the adaptive filter 107 as a reference signal. Then, the adaptive filter 107 convolutes a filter coefficient into a reference signal acquired from the delay unit 106, and outputs a pseudo feedback signal to the subtractor 102. The subtractor 102 subtracts the pseudo feedback signal from an input signal (target signal) from the microphone 101, thereby eliminating a feedback component (howling component) included in the target signal, and outputs an error signal.

The adaptive filter 107 is, for example, a FIR filter with 256 taps. The filter coefficient of the adaptive filter 107 is updated using, for example, an adaptive algorithm which operates under a criterion to minimize mean squared error between the target signal and the error signal. As the algorithm for updating the adaptive filter 107, various known adaptive algorithms, such as an NLMS algorithm are used. The mean squared error is minimized when the adaptive filter 107 accurately estimates spatial transfer characteristics.

In this configuration, proceeding with updating of the filter coefficient increases accuracy in estimation of the spatial transfer characteristics by the adaptive filter 107, and the adaptive filter 107 outputs a pseudo feedback signal proximate to a feedback signal. As a result, the error signal, which is obtained by removing the pseudo feedback signal from the target signal, outputted from the subtractor 102 allows a user to hear a sound as desired.

Note that in FIG. 1, although the delay unit 106 receives the output signal of the sound processing unit 103 as an input, the delay unit 106 may be configured to receive, as an input, the output signal (error signal) of the subtractor 102 or the output signal of the amplifier 104.

Next, operation of the coefficient update control unit 108 in Embodiment 1 will be described. The coefficient update control unit 108 is provided to perform control of the update of the filter coefficient of the adaptive filter 107.

The input terminals 201 and 202 receive input of the input signal (target signal) and the error signal of the microphone 101, respectively. The level calculation unit 203 calculates a signal level of the target signal inputted to the input terminal 201. The level calculation unit 204 calculates a signal level of the error signal inputted to the input terminal 202. The convergence analysis unit 205 calculates mean squared error between the signal level of the target signal and the signal level of the error signal. The mean squared error is an index to be used to determine the degree of convergence of the adaptive filter 107. The value of the mean squared error can be used as a reference which indicates the amount of feedback signal components remaining in the error signal.

Examples of the mean squared error include a ratio of the square of the signal level of the error signal to the square of the signal level of the target signal. Note that the mean squared error is not limited to this and may be a difference between the square of the signal level of the target signal and the square of the signal level of the error signal. Also note that the parameters for calculation of the mean squared error are not limited to a set of a target signal and an error signal. For example, the mean squared error may be mean squared error between a target signal and a pseudo feedback signal or mean squared error between a pseudo feedback signal and an error signal.

Figure 3:
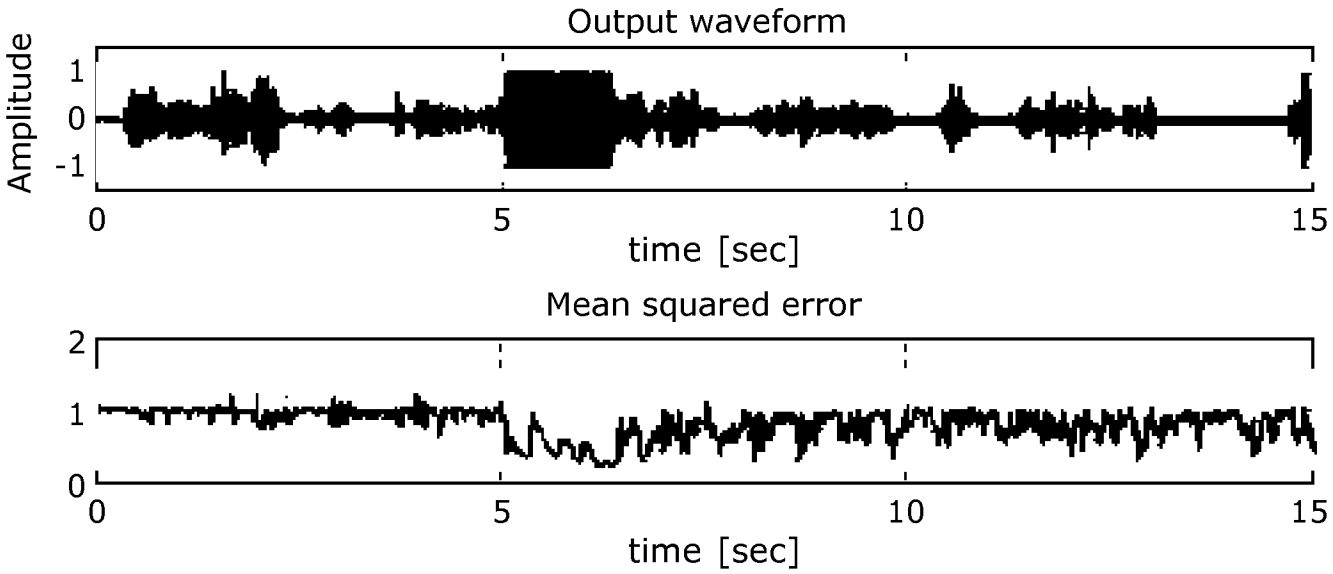
FIG. 3 is a graph illustrating mean squared error calculated by a convergence analysis unit of the howling suppression device in Embodiment 1.

FIG. 3 is a graph illustrating a case where a mixed signal of sound and noise is inputted to the microphone 101 while the adaptive filter 107 operates at a constant rate, and howling is intentionally caused at the fifth second. The waveform is a time waveform and the lower waveform depicts mean squared error calculated by the convergence analysis unit 205. The howling caused at the fifth second ends in approximately two seconds. The waveform of the mean squared error shows a decrease concurrent with the occurrence of the howling and a rise upon the end of the howling. The decrease in the mean squared error indicates increase in the degree of convergence of the adaptive filter 107 by identifying the howling.

In other words, the convergence analysis unit 205 can use this to determine the degree of convergence of the adaptive filter 107. The convergence analysis unit 205 shown in FIG. 2 compares the mean squared error and a predetermined threshold value. When the mean squared error is below the threshold value, the convergence analysis unit 205 sets the value of a first detection flag (convergence flag) to 1. When the mean squared error is greater than or equal to the threshold value, the convergence analysis unit 205 sets the value of the first detection flag (convergence flag) to 0. Note that the above-described set values of the first detection flag are merely examples, and the present invention will not be limited to this. More specifically, the first detection flag needs to be set to one of a value indicating that the degree of convergence of the adaptive filter 107 is above a criterion value (in this example, the value of "1") the a value indicating that the degree of convergence of the adaptive filter 107 is less than or equal to the criterion value (in this example, the value of "0"), and the other is optional. The same applies to the values to be set for other flags described below.

The change amount analysis unit 206 is a block provided to detect occurrence of howling more accurately than when only the mean squared error calculated by the convergence analysis unit 205 is used. The change amount analysis unit 206 analyzes the amount of change in the input mean squared error with time. More specifically, the change amount analysis unit 206 calculates a slope of mean squared error between a past time (t−n) and a current time t. When the slope of mean squared error between a past time (t−n) and a current time t is negative, the change amount analysis unit 206 determines that the degree of convergence of the adaptive filter 107 has increased. When the slope is positive, the change amount analysis unit 206 determines that the degree of convergence of the adaptive filter 107 has not increased. Furthermore, in the case where the slope of mean squared error has remained negative for a predetermined period of time, the change amount analysis unit 206 may determine that the convergence has been continuing.

Note that the phrase "the slope of mean squared error between a past time (t−n) and a current time t is negative" does not necessarily indicate that the mean squared error has been monotonically decreasing but may also mean that the mean squared error has been on the decrease.

Since the convergence analysis unit 205 uses the values of the mean squared error as such, a sound other than a howling sound may be falsely detect when the degree of convergence of the adaptive filter 107 is likely to increase for a signal of the sound. In contrast, the change amount analysis unit 206 analyzes continuity of convergence with respect to time so that false detection can be reduced for input signals which rapidly changes with time, such as a signal of speech. As with the convergence analysis unit 205, the change amount analysis unit 206 sets the value of a second detection flag based on the result of the determination of a threshold value. When the calculated slope value of mean squared error plotted against time is below a threshold value, the change amount analysis unit 206 sets the value of the second detection flag (change amount flag) to 1. When the calculated slope of mean squared error is greater than or equal to the threshold value, the change amount analysis unit 206 sets the value of the second detection flag (change amount flag) to 0.

The state determination unit 207 determines whether or not any part of the signal inputted to the microphone 101 indicates howling, based on the convergence flag outputted from the convergence analysis unit convergence flag 205 and the change amount flag outputted from the change amount analysis unit 206. More specifically, the state determination unit 207 refers to the convergence flag and the change amount flag. When both the flags are on (in the above-described case, both the flags are set to "1"), the state determination unit 207 determines that howling is occurring and turns on an acceleration flag (sets the acceleration flag to "1"). When at least one of the convergence flag or the change amount flag is off (in the above-described case, at least one of the flags is set to "0"), the state determination unit 207 determines that howling is not occurring and does not turn on an acceleration flag (sets the acceleration flag to "0", for example).

The update rate control unit 208 sets the update rate of the adaptive filter 107 according to the value of the acceleration flag indicated by a signal outputted by the state determination unit 207. More specifically, when the acceleration flag inputted from the state determination unit 207 has a value of "1", the update rate control unit 208 sets the value of the update rate to a larger value (sets to a first rate). When the acceleration flag inputted from the state determination unit 208 has a value of "0", the update rate control unit 208 sets the value of the update rate to a smaller value (sets to a second rate that is lower than the first rate). Then, the update rate control unit 208 outputs the set update rate to the adaptive filter 107. Note that the "update rate" refers to the update amount of the filter coefficient per unit time. To be more specific, the update rate can be restated as the amount of change in the filter coefficient in one update processing.

Figure 4:
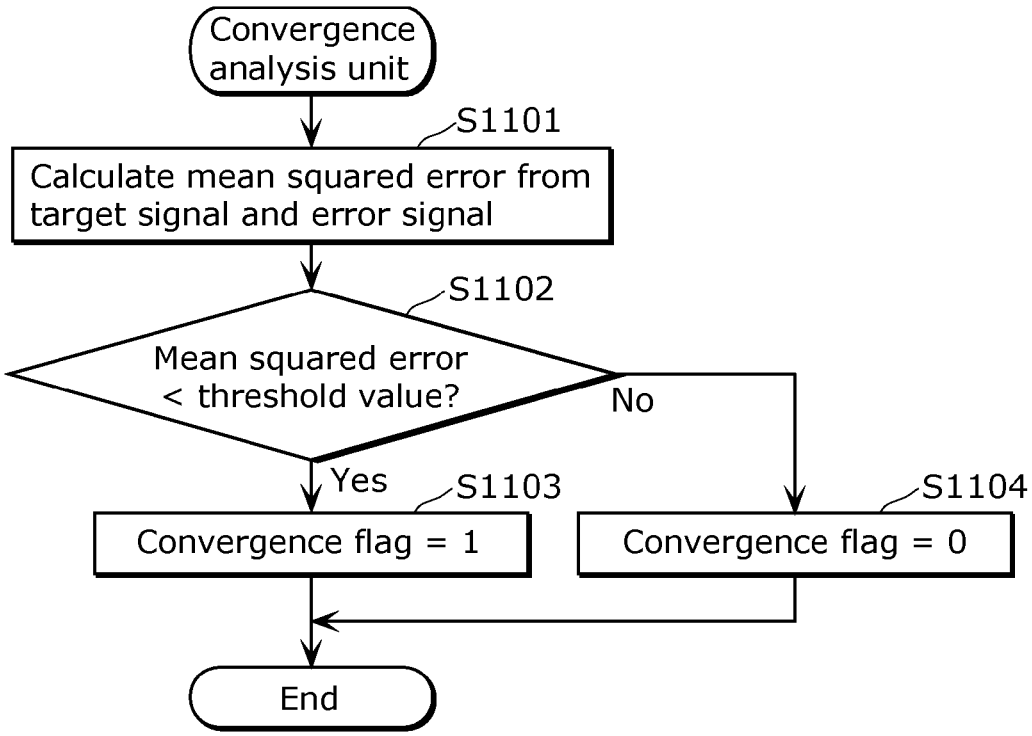
FIG. 4 is a flowchart illustrating operation of a convergence analysis unit of the howling suppression device in Embodiment 1.
Figure 5:
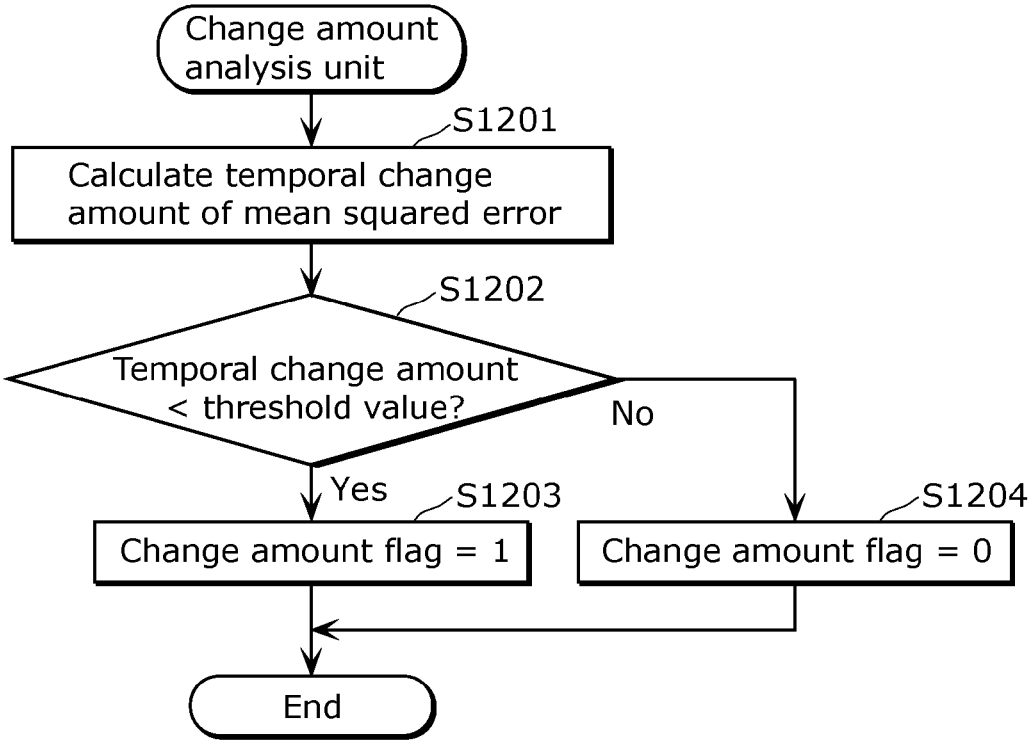
FIG. 5 is a flowchart illustrating operation of a change amount analysis unit of the howling suppression device in Embodiment 1.
Figure 6:
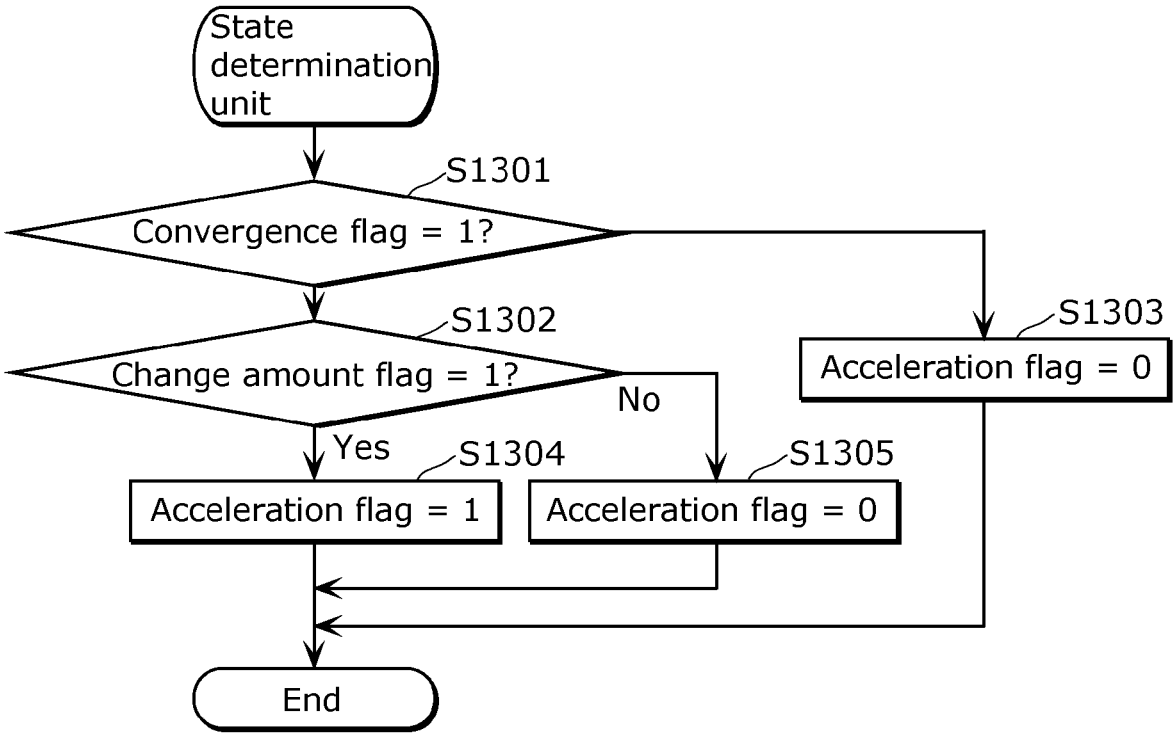
FIG. 6 is a flowchart illustrating operation of a state determination unit of the howling suppression device in Embodiment 1.

FIG. 4 to FIG. 6 are flowcharts illustrating operation of the coefficient update control unit 108 in FIG. 2 implemented in software.

FIG. 4 is a flowchart illustrating operation of the convergence analysis unit 205. The convergence analysis unit 205 calculates mean squared error between the signal level of the target signal and the signal level of the error signal (S1101). Next, the convergence analysis unit 205 compares the value of the calculated mean squared error and a predetermined threshold value (S1102). When the mean squared error is below the threshold value (S1102, Yes), the convergence analysis unit 205 sets the convergence flag to 1 (S1103) and outputs the convergence flag to the state determination unit 207. When the mean squared error is greater than or equal to the threshold value (S1102, No), the convergence analysis unit 205 sets the convergence flag to 0 (S1104) and outputs the convergence flag to the state determination unit 207. The basis of the determination made in Step S1101 in FIG. 4 is not limited to the comparison between mean squared error and a threshold value of a present time. Alternatively, the convergence analysis unit 205 may determine that the condition in Step S1101 is satisfied in the case where the mean squared error has remained below a predetermined threshold value for a predetermined period of time.

FIG. 5 is a flowchart illustrating operation of the change amount analysis unit 206. The change amount analysis unit 206 obtains the mean squared error from the convergence analysis unit 205 and calculates the amount of change in the mean squared error with time (S1201). Next, the change amount analysis unit 206 compares the calculated temporal change amount and a predetermined threshold value (S1202). When the temporal change amount is below the threshold value (S1202), the change amount analysis unit 206 sets the value of a change amount flag to 1 (S1203) and outputs the change amount flag to the state determination unit 207. When the temporal change amount is below the threshold value (S1202, No), the change amount analysis unit 206 sets the value of a change amount flag to 0 (S1204) and outputs the change amount flag to the state determination unit 207.

FIG. 6 is a flowchart illustrating operation of the state determination unit 207. First, the state determination unit 207 checks the value of the convergence flag obtained from the convergence analysis unit 205 to determine whether or not a first condition is satisfied (S1301). Next, when the value of the convergence flag is 0 (S1301, No), the state determination unit 207 sets the value of an acceleration flag to 0 (S1303) and outputs the acceleration flag to the update rate control unit 208. When the value of the convergence flag is 1 (S1301, Yes), the state determination unit 207 checks the value of the change amount flag obtained from the change amount analysis unit 206 to determine whether or not a second condition is satisfied (S1302). Next, when the value of the change amount flag is 0 (S1302, No), the determination unit 207 sets the value of an acceleration flag to 0 (S1305) and outputs the acceleration flag to the update rate control unit 208. When the value of the change amount flag is 1 (S1302, Yes), the determination unit 207 sets the value of an acceleration flag to 1 (S1304) and outputs the acceleration flag to the update rate control unit 208. The order of the checking of a convergence flag and the checking of a change amount flag is not limited to the example shown in FIG. 6. The value of a convergence flag may be checked after the value of the change amount flag is checked.

In this configuration, the time to accelerate convergence of the adaptive filter 107 can be automatically determined based on analysis of mean squared error calculated from a target signal and an error signal, and thereby the update rate of the adaptive filter 107 can be changed according to the calculated time for acceleration. With this, the filter coefficient of the adaptive filter 107 is updated at a higher rate only while howling is occurring, so that the howling can be rapidly suppressed.

The basis of the determination by the change amount analysis unit 206 in FIG. 2 is not limited to the slope value of a line of mean squared error but may be a difference between two values of mean squared error of two difference times or a magnitude relationship between two values of mean squared error of two difference times. In another possible configuration, the change amount analysis unit 206 may check whether or not the slope value of mean squared error plotted against time continues to indicate decrease for a certain period of time, and turn on the change amount flag only when such continuity is present.

In this configuration, not only a momentary mean squared error but also temporal continuity of the slope value of a line of mean squared error plotted against time is included in conditions to determine whether or not howling is occurring. Accordingly, it is possible to distinguish a state in which the degree of convergence of the adaptive filter 107 has been increasing for over a certain period of time. This enables detection of howling with higher accuracy.

Figure 7:
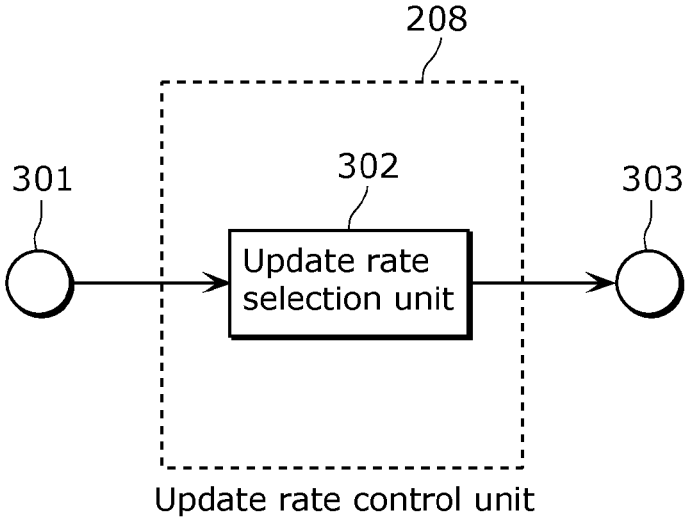
FIG. 7 is a detailed block diagram of an update rate control unit of the howling suppression device in Embodiment 1.

FIG. 7 is a detailed block diagram of the update rate control unit 208 in Embodiment 1.

In FIG. 7, the update rate control unit 208 according to Embodiment 1 includes: an input terminal 301, an update rate selection unit 302, and an output terminal 303.

The input terminal 301 receives the output signal of the state determination unit 207 in FIG. 2. The output signal of the state determination unit 207 is the acceleration flag, which is set to 1 when howling is occurring and set to 0 when howling is not occurring. The update rate selection unit 302 stores predetermined update rates of the adaptive filter 107 including types of a first rate and a second rate. The first rate has a value for accelerating adaptation, and the second rate has a value for normal adaptation. When the received acceleration flag has a value of 1, the update rate selection unit 302 determines the value for accelerating adaptation as the update rate of the adaptive filter 107 and outputs the value to the output terminal 303. When the received acceleration flag has a value of 0, the update rate selection unit 302 determines the value for normal adaptation as the update rate of the adaptive filter 107 and outputs the value to the output terminal 303.

Figure 8:
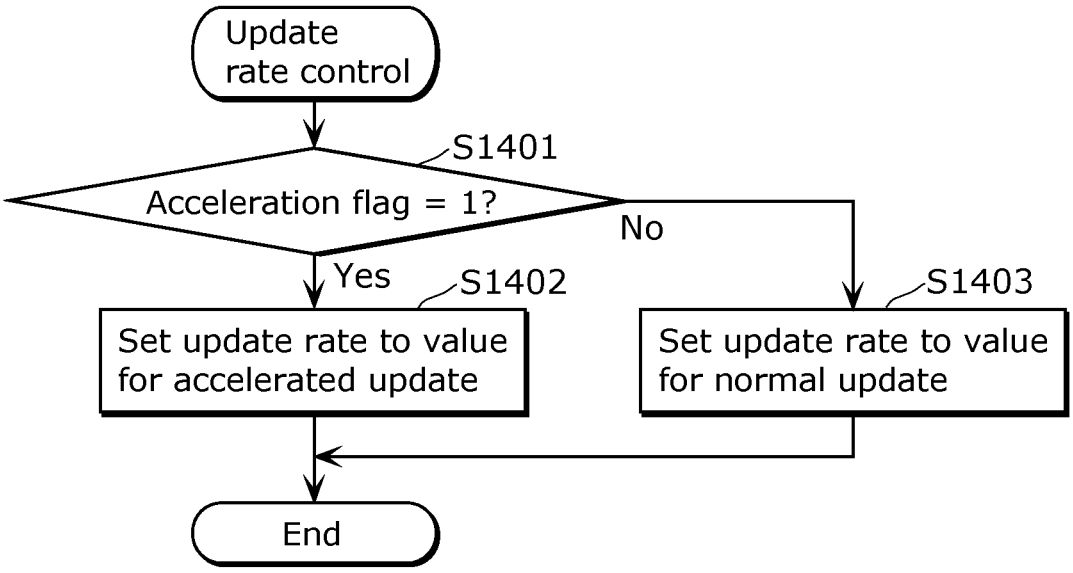
FIG. 8 is a flowchart illustrating operation of the update rate control unit of the howling suppression device in Embodiment 1.

FIG. 8 is a flowchart illustrating operation of the update rate control unit 208. The update rate control unit 208 identifies the value of the acceleration flag received from the state determination unit 207 (S1401). Next, when the acceleration flag has a value of 1 (S1401), the update rate control unit 208 sets the update rate of the adaptive filter 107 to the predetermined value for accelerated update (S1402). When the acceleration flag has a value of 0 (S1402), the update rate control unit 208 sets the update rate of the adaptive filter 107 to a normal update (S1403).

In this configuration, the update rate selection unit 302 stores predetermined parameter values for control of update and selects one of the values according to an input signal to change the update rate of the adaptive filter 107. It is thus possible to rapidly suppress howling.

Embodiment 2

A coefficient update control unit according to Embodiment 2 further includes a frequency analysis unit configured to convert the signal level of an input signal into a frequency signal, and a peak detection unit configured to determine whether or not a third condition that the frequency signal has a peak is satisfied. When all of the first to third conditions are satisfied, the update rate control unit sets the update rate to the first rate. When at least one of the first condition, the second condition, or the third condition is not satisfied, the update rate control unit sets the update rate to the second rate.

Figure 9:
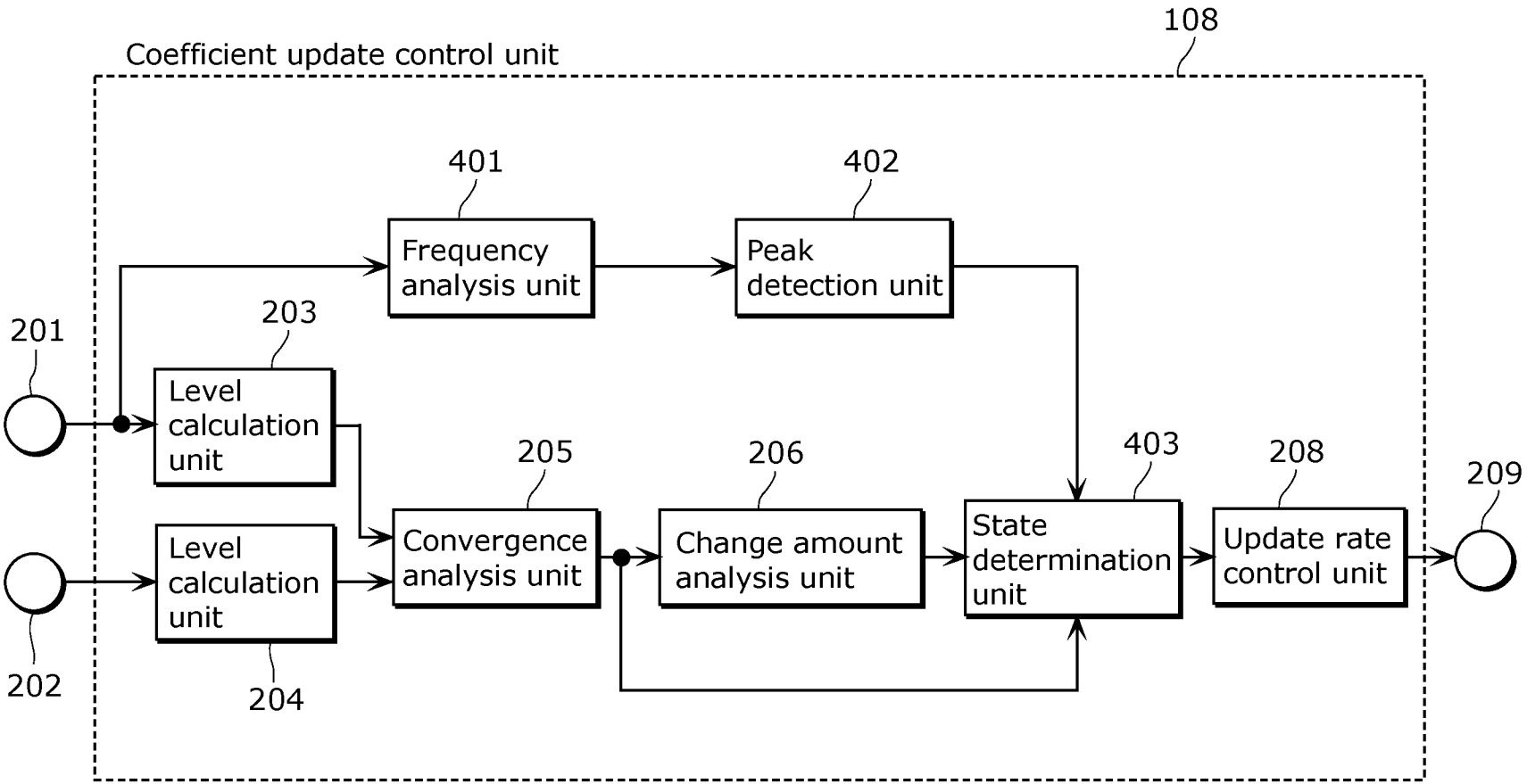
FIG. 9 is a detailed block diagram of a coefficient update control unit of a howling suppression device in Embodiment 1.

Referring to FIG. 9, a coefficient update control unit 108 according to Embodiment 2 will be described in detail. FIG. 9 is a detailed block diagram of the coefficient update control unit 108 in Embodiment 2. Note that in FIG. 9, like components as those of FIG. 2 are given like reference signs thereby omitting the description thereof.

In FIG. 9, the coefficient update control unit 108 according to Embodiment 2 includes a frequency analysis unit 401 and a peak detection unit 402. The frequency analysis unit 401 converts a time signal inputted to the input terminal 201 to a signal in frequency domain. The peak detection unit 402 analyzes the signal in frequency domain outputted from the frequency analysis unit 401 to detect a frequency peak. A state determination unit 403 according to Embodiment 2 determines whether or not a signal inputted to a microphone 101 includes any howling component, based on a convergence flag outputted from the convergence analysis unit 205, a change amount flag outputted from the change amount analysis unit 206, and a result of the determination (peak detection flag) outputted from the peak detection unit 402.

The frequency analysis unit 401 divides an output signal (target signal) of the microphone 101 acquired through the input terminal 201 into a plurality of subband signals by performing frequency transformation. As a method for the frequency transformation, a known method for dividing a time signal into a plurality of subband signals is used, such as a fast Fourier transformation or a filter bank made up of a plurality of FIR filters or IIR filters. The peak detection unit 402 analyzes frequency characteristics of the subband signals in the frequency domain to detect frequency peaks, and outputs the total number of the frequency peaks.

Figure 10:
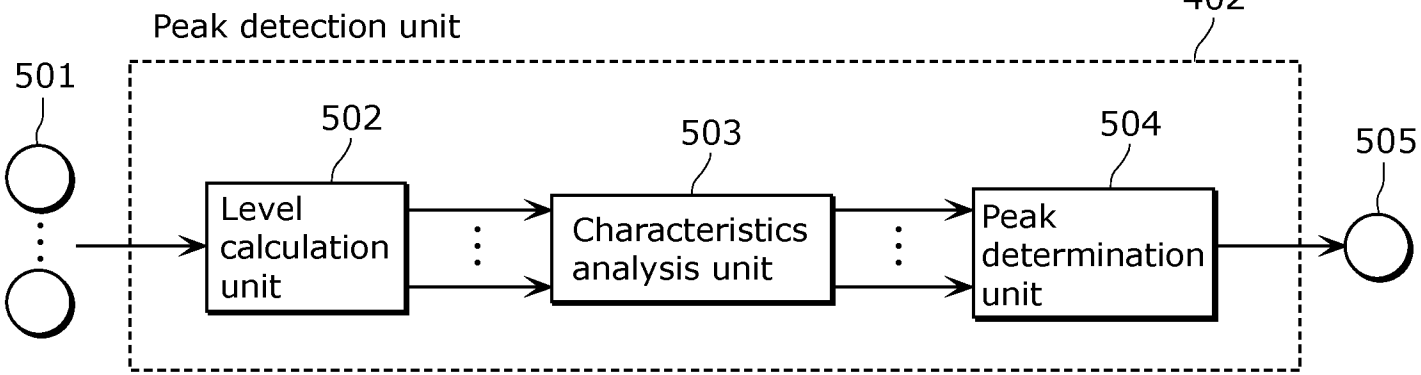
FIG. 10 is a detailed block diagram of a peak detection unit of the howling suppression device in Embodiment 2.

FIG. 10 is a detailed block diagram of the peak detection unit 402 in Embodiment 3.

In FIG. 10, the peak detection unit 402 according to Embodiment 2 includes: an input terminal 501 which inputs a subband signal in each frequency domain to the peak detection unit 402; a level calculation unit 502 which calculates the signal level of the input signal of each subband; a characteristics analysis unit 503 which analyzes characteristics of the input signal from the signal levels of the plurality of subbands; a peak determination unit 504 which receives frequency characteristics output from the characteristics analysis unit 503 and detects a frequency peak; and an output terminal 505 which outputs an output result of the peak determination unit 504.

The subband signals in the frequency domain, which have been divided by the frequency analysis unit 401 shown in FIG. 10 are inputted to the level calculation unit 502 for each subband. The level calculation unit 502 calculates a signal level of the inputted signal in frequency domain for each subband. The characteristics analysis unit 503 analyzes the frequency characteristics from the inputted signal level in each subband. More specifically, the characteristics analysis unit 503 calculates and outputs a level ratio of the signal levels between adjacent subbands. The peak determination unit 504 compares the level ratios of the signal levels outputted from the characteristics analysis unit 503 with a predetermined threshold value. When any of the level ratios is above the threshold value, the peak determination unit 504 determines that a sinusoidal signal is present and increments a peak counter by one. The output terminal 505 outputs the peak counter as the number of peak frequencies counted by the peak determination unit 504.

In FIG. 9, finally, the state determination unit 403 determines whether or not howling is occurring, based on three parameters of the peak counter outputted from the peak detection unit 402, the convergence flag outputted from the convergence analysis unit 205, and the change amount flag outputted from the change amount analysis unit 206. Since howling is indicated by a sinusoidal signal having a single sharp frequency peak, howling can be detected with higher accuracy by using the number of frequency peaks for state determination. More specifically, the state determination unit 403 determines that howling is occurring and sets an acceleration flag to 1 only when both the first flag and the second flag have a value of 1 and the number of peaks outputted from the peak detection unit 402 is 1 (the third condition).

In this configuration, analysis of the signal in frequency domain (peak number) is provided to the state determination unit 403, and frequency characteristics of an input signal are used as a criterion for determination. It is thus possible to detect howling with higher accuracy.

Figure 11:
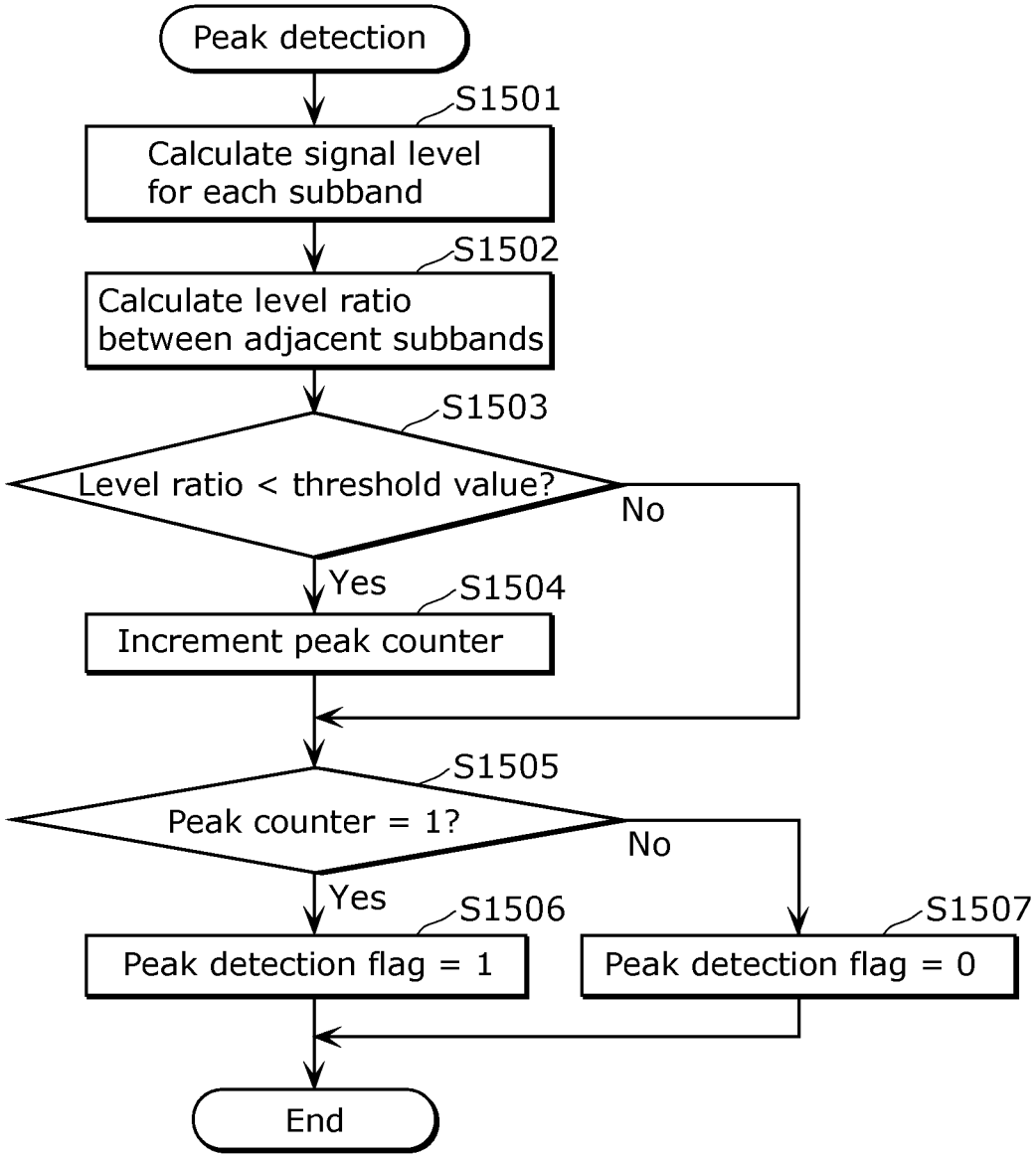
FIG. 11 is a flowchart illustrating operation of the peak detection unit of the howling suppression device in Embodiment 2.

FIG. 11 is a flowchart illustrating operation of the peak detection unit 402. First, upon receiving a signal in frequency domain from the frequency analysis unit 401, the level calculation unit 502 calculates a signal level for each subband (S1501). Next, using the calculated signal levels of the subbands, the characteristics analysis unit 503 calculates a level ratio between adjacent ones of the subbands (S1502). Next, the peak determination unit 504 compares the level ratios with a predetermined threshold value (S1503), and increments a peak counter by one for each level ratio higher than the threshold value (S1504). Next, the peak determination unit 504 performs peak determination based on the value of the peak counter (S1505). When the peak counter has a value of 1 (S1505, Yes), the peak determination unit 504 determines that howling is occurring and sets a peak detection flag to 1 (S1506). When the peak counter has a value other than 1 (S1505, No), the peak determination unit 504 sets a peak detection flag to 0 (S1507).

In this configuration, detection of peaks in frequency characteristics is performed based on a level ratio of signal levels between subbands so that howling can be detected more accurately and update of the filter coefficient of the adaptive filter 107 can be controlled appropriately.

In Embodiment 2, the method of detecting a peak is not limited to the above-described method in which the characteristics analysis unit 503 calculates a signal level ratio between adjacent subbands but may alternatively include calculation of a difference in signal level between two adjacent subbands or may be performed using a magnitude relationship between two adjacent subbands.

In Embodiment 2, when the peak detection unit 402 counts frequency peaks, the value of a counter flag may be incremented by one for each frequency peak lasting a certain period of time.

Embodiment 3

A coefficient update control unit according to Embodiment 3 further includes an audio detection unit which determines whether or not a fourth condition that the signal level of an input signal has a maximum value above a predetermined value is satisfied. When all of the first, second, and fourth conditions are satisfied, the update rate control unit sets the update rate to the first rate. When at least one of the first, second, or fourth condition is not satisfied, the update rate control unit sets the update rate to the second rate.

Figure 12:
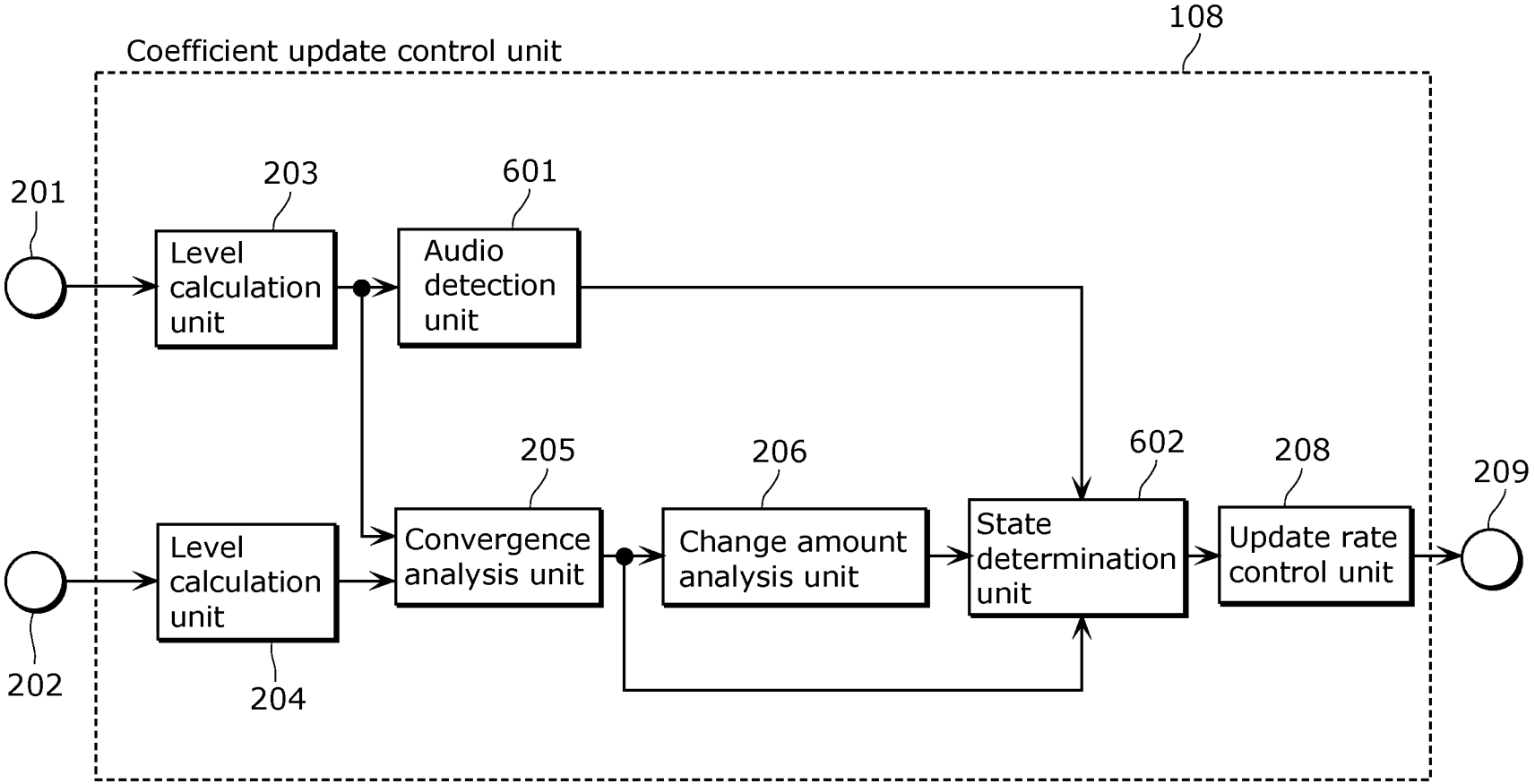
FIG. 12 is a detailed block diagram of a coefficient update control unit of the howling suppression device in Embodiment 3.

Referring to FIG. 12, the coefficient update control unit 108 according to Embodiment 3 will be described in detail below. FIG. 12 is a detailed block diagram of the coefficient update control unit 108 in Embodiment 3. Note that in FIG. 12, like components as those of FIG. 2 are given like reference signs thereby omitting the description thereof.

In FIG. 12, the coefficient update control unit 108 according to Embodiment 3 includes an audio detection unit 601 which determines whether or not a howling signal is present, based on the signal level of an input signal received from the level calculation unit 203. The state determination unit 602 according to Embodiment 3 then determines whether or not howling is occurring, based on output from the audio detection unit 601, the convergence analysis unit 205, and the change amount analysis unit 206.

The audio detection unit 601 receives the signal level of an input signal calculated by the level calculation unit 203. Howling is an oscillation phenomenon of signal, and the signal level of an input signal has a large value while howling is occurring. Taking advantage of this, the audio detection unit 601 compares the signal level of the input signal and a threshold value. When the signal level of the input signal is higher than or equal to the threshold value, the audio detection unit 601 sets a signal detection flag to 1 and outputs the signal detection flag to the state determination unit 602. When the signal level of the input signal is lower than the threshold value, the audio detection unit 602 sets a signal detection flag to 0 and outputs the signal detection flag to the state determination unit 602. The state determination unit 602 determines whether or not howling is occurring, based on a convergence flag received from the convergence analysis unit 205, a change amount flag received from the change amount analysis unit 206, and the signal detection flag received from the audio detection unit 601. More specifically, the state determination unit 602 determines that howling is occurring and sets an acceleration flag to 1 when a convergence flag is set to 1 based on a threshold value determination of mean squared error, a change amount flag is set to 1, and the signal detection flag is set to 1 (the fourth condition).

In this configuration, information on a signal level is added to conditions for control of update of filter coefficients of the adaptive filter 107, and the amplitude of an input signal is thereby also used as a basis of determination as to whether or not howling is occurring. As a result, filter coefficients of the adaptive filter 107 are thus updated more appropriately.

Embodiment 4

An update rate control unit according to Embodiment 4 sets the first rate at a higher level when the mean squared error between an input signal and an error signal in signal level has a smaller value, when the first and second conditions are satisfied.

Figure 13:
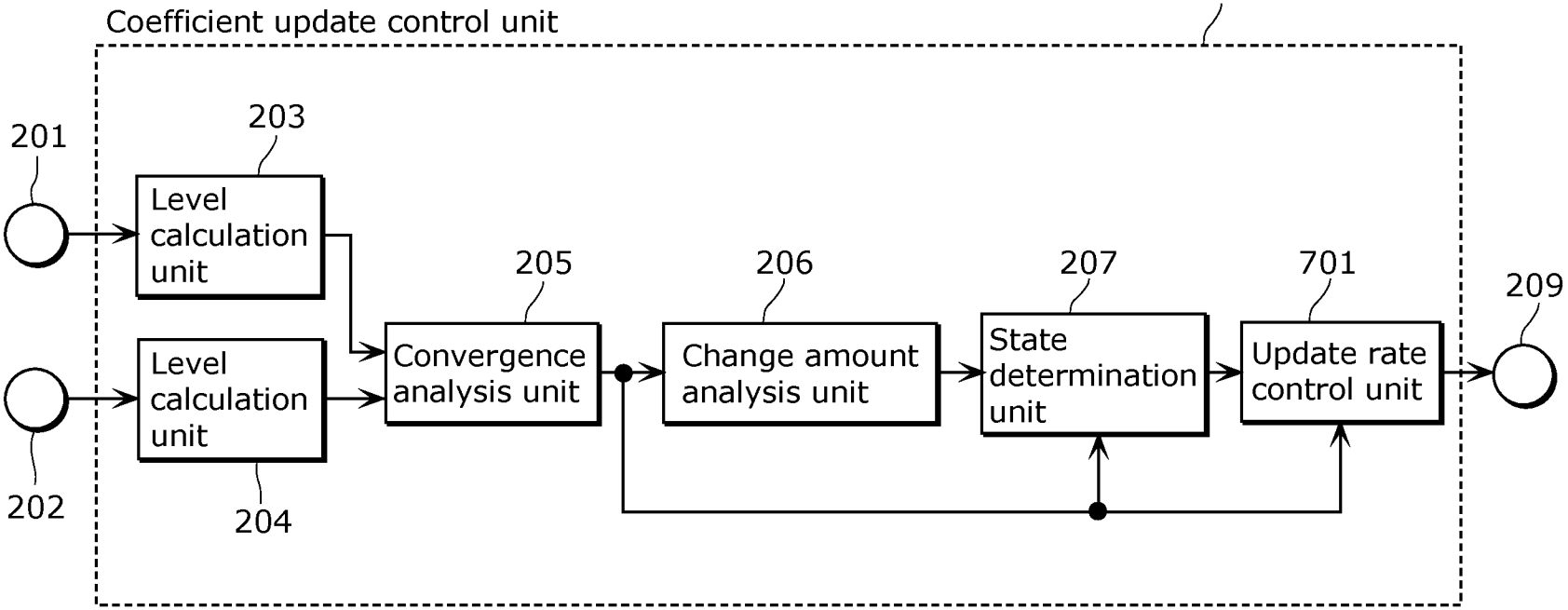
FIG. 13 is a detailed block diagram of a coefficient update control unit of a howling suppression device in Embodiment 4.

Referring to FIG. 13, the coefficient update control unit 108 according to Embodiment 4 will be described in detail below. FIG. 13 is a detailed block diagram of the coefficient update control unit 108 in Embodiment 4. Note that in FIG. 13, like components as those of FIG. 2 are given like reference signs thereby omitting the description thereof.

In FIG. 13, the coefficient update control unit 108 according to Embodiment 1 further includes an update rate control unit 701.

The update rate control unit 701 receives two signals: one indicting an acceleration flag outputted from the state determination unit 207; and the other indicating the value of mean squared error outputted from the convergence analysis unit 205. The value of mean squared error is a parameter indicating the degree of convergence of the adaptive filter 107 in response to an input signal. Thus, when an acceleration flag is 1 (it is determined that howling is occurring), the update rate control unit 701 can utilize the value of the mean squared error as a guide for acceleration of the adaptive filter 107. Taking advantage of this, when an acceleration flag is 1, the update rate control unit 701 determines an update rate of the adaptive filter 107 by converting the value of mean squared error and outputs the determined update rate.

In this configuration, the update rate control unit 701 determines an update rate using the value of mean squared error, and it is thereby possible to control update of filter coefficients of the adaptive filter 107 at an update rate having a value optimized for an input signal.

Figure 14:
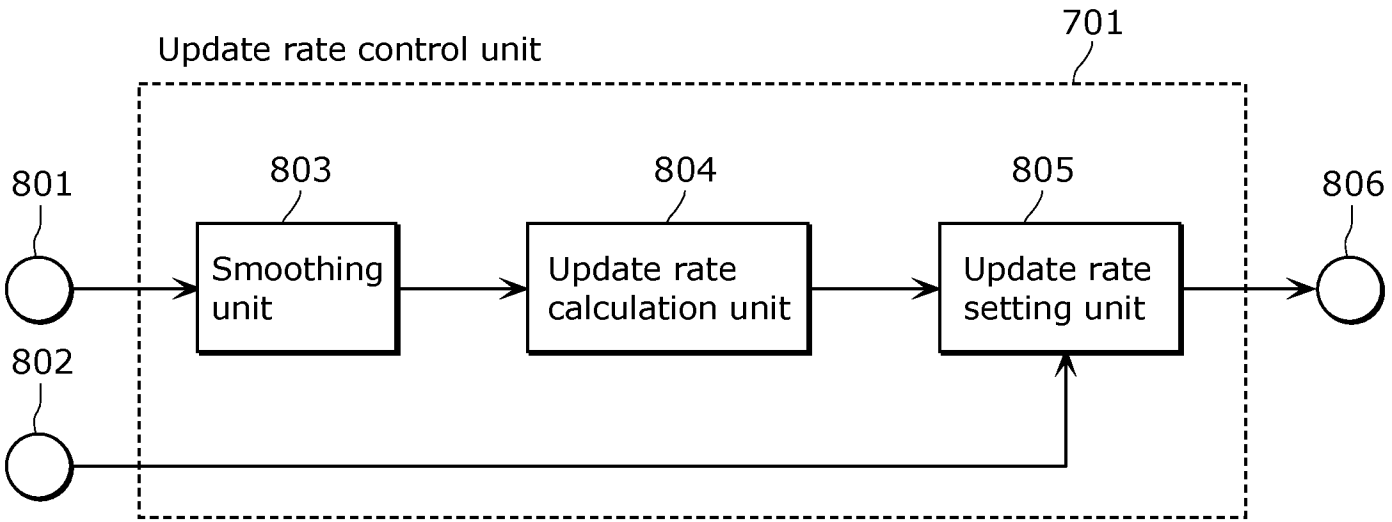
FIG. 14 is a detailed block diagram of an update rate control unit of the howling suppression device in Embodiment 4.

FIG. 14 is a detailed block diagram of the update rate control unit 701 in Embodiment 4.

In FIG. 14, the update rate control unit 701 according to Embodiment 4 includes: an input terminal 801 which receives mean squared error outputted from the convergence analysis unit 205; an input terminal 802 which receives an acceleration flag outputted from the state determination unit 207; a smoothing unit 803 which smoothes values of mean squared error received from the input terminal 801; an update rate calculation unit 804 which calculate an update rate of the adaptive filter 107 from the mean squared error after the smoothing outputted from the smoothing unit 803; an update rate setting unit 805 which finalizes an update rate of the adaptive filter 107 based on the value of the acceleration flag received from the input terminal 802 and the update rate calculated by the update rate calculation unit 804; and an output terminal 806 which outputs the finalized update rate to the adaptive filter 107.

Receiving mean squared error, the smoothing unit 803 smoothes mean squared error by eliminating small time jitters in the mean squared error so that the mean squared error can be easily converted into an update rate of the adaptive filter 107. The smoothed signal (mean squared error) is inputted into the update rate calculation unit 804. The update rate calculation unit 804 converts the smoothed mean squared error into an index for determination of an update rate of the adaptive filter 107.

Figure 15:
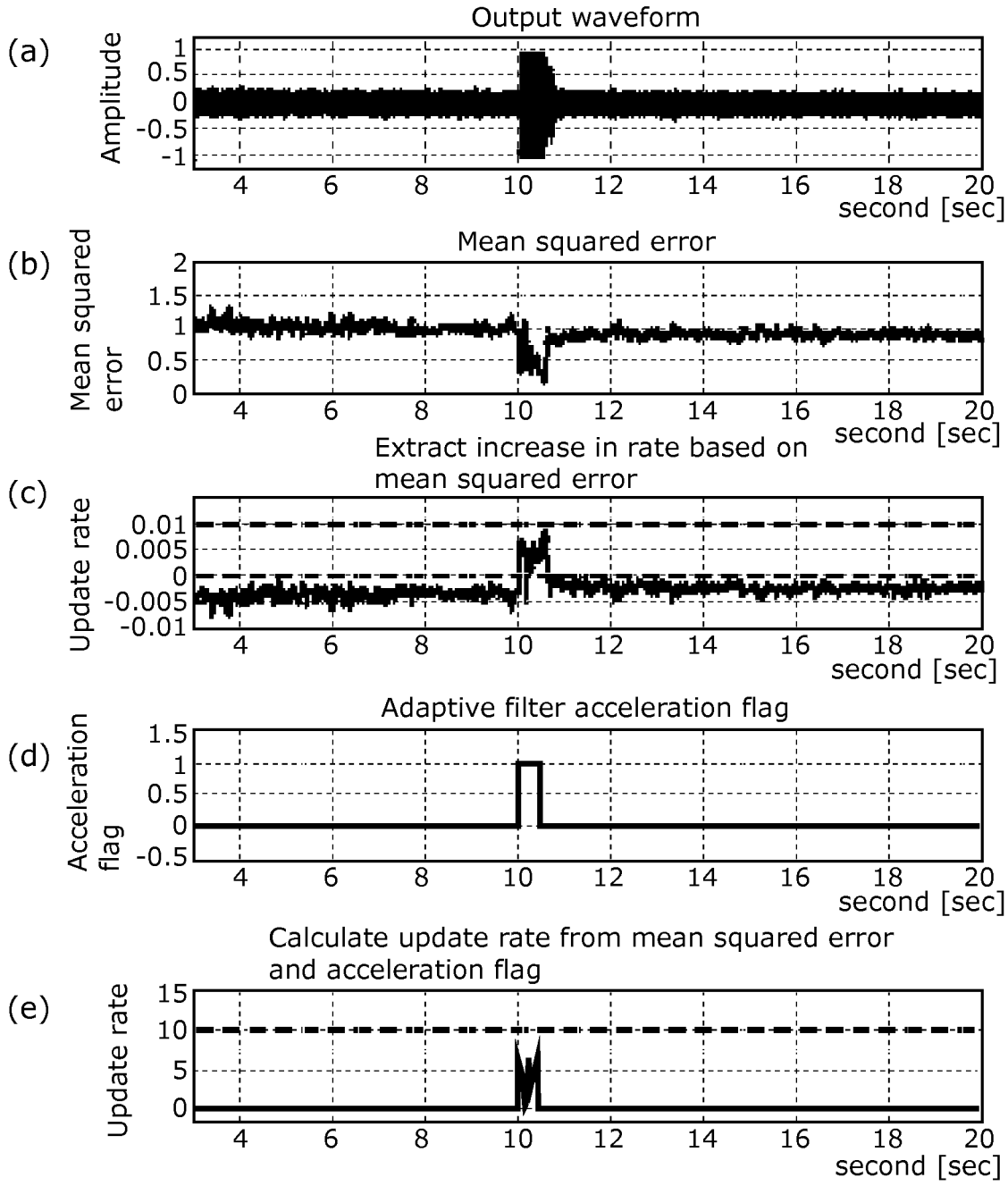
FIG. 15 is a graph illustrating a process of conversion from mean squared error into update rate performed by the update rate calculation unit of the howling suppression device in Embodiment 4.

FIG. 15 shows graphs depicting intermediate signals calculated in the process performed by the update rate calculation unit 804 in FIG. 14. (a) in FIG. 15 illustrates a final output signal for an input signal which is white noise when howling is caused by a change in a system at the tenth second. Referring to (a) in FIG. 15, the output signal has increased amplitude for approximately one second from the tenth second, which indicates occurrence of howling.

(b) in FIG. 15 illustrates mean squared error corresponding to the signal shown in (a) in FIG. 15. The mean squared error sharply decreases when howling occurs at the tenth second. (c) in FIG. 15 is a graph of values obtained by converting values of the mean squared error in (b) in FIG. 15 by providing an offset of approximately 1 dB to the values of the mean squared error and reversing the values with the offset so that only a reversed sharp decrease in the mean squared error exceeds zero.

(d) in FIG. 15 illustrates the acceleration flag set by the state determination unit 207. (e) in FIG. 15 is a graph of values obtained by mapping the values in (c) in FIG. 15 within a predetermined range between a lower limit value and an upper limit value of update rate and converting the mapped values for a large fluctuation of the mean squared error only into the update rate of the adaptive filter 107.

Subsequently, the update rate setting unit 805 sets the update rate calculated by the update rate calculation unit 804 as a final update rate and outputs to the output terminal 806 when the acceleration flag received from the input terminal 802 is 1, and sets the update rate to a normal level and outputs to the output terminal 806 when the acceleration flag is 1.

Figure 16:
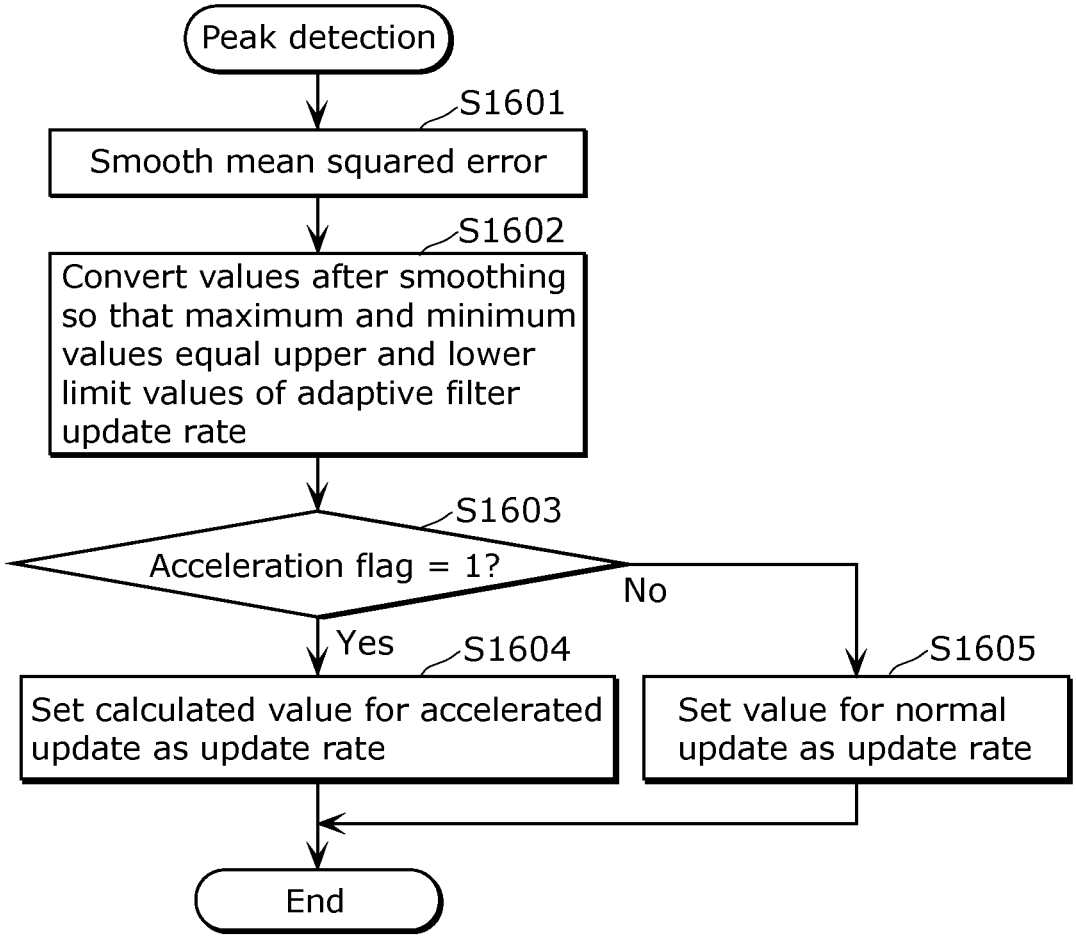
FIG. 16 is a flowchart illustrating operation of the update rate control unit of the howling suppression device in Embodiment 4.

FIG. 16 is a flowchart illustrating operation of the update rate control unit 701. First, the smoothing unit 803 smoothes mean squared error outputted from the convergence analysis unit 205 by removing minute fluctuation of the mean squared error to roughly extract fluctuation of the mean squared error (S1601). Next, the update rate calculation unit 804 converts the values of the smoothed mean squared error so that the maximum value and the minimum value of the mean squared error after being converted are respectively equal to the predetermined upper limit value and lower limit value of the parameters indicating the update rates of the adaptive filter 107 (S1602). Next, the update rate setting unit 805 checks the value of the acceleration flag inputted to the update rate control unit 701 (S1603). When the acceleration flag has a value of 1 (S1603, Yes), the update rate setting unit 805 sets a value of an update rate obtained by converting the mean squared error in Step S1602 as the update rate of the adaptive filter 107 (S1604). When the acceleration flag has a value other than 1 (S1603, No), the update rate setting unit 805 sets the update rate of the adaptive filter 107 to a value for normal update (S1605).

In this configuration, the update rate of the adaptive filter 107 can be controlled using an update rate optimized for an input signal by converting the values of mean squared error so that the values correspond to the update rates of the adaptive filter 107.

The values of the mean squared error converted to update rates of the adaptive filter 107 by the update rate calculation unit 804 need not be continuous. For example, the mean squared error may be mapped, by bit shifting, to discrete parameters which are powers of two set between the predetermined lower limit value and upper limit value of the update rate.

The howling suppression device according to each embodiment described above can be utilized in, for example, a hearing aid. To be specific, such a hearing aid includes a sound pickup unit (microphone) which picks up ambient sound and converts it into input signals, the howling suppression device according to any one of the above embodiments, and an output unit (speaker) which converts an error signal generated by a subtractor into an output sound and outputs the sound.

Although the present invention is described based on the above embodiments, it should be understood that the present invention is not limited to the embodiments. The following is also within the scope of the present invention.

(1) Each of the devices described above can be implemented specifically as a computer system including a microprocessor, a ROM, a RAM, a hard disk unit, a display unit, a keyboard, and a mouse. The RAM or the hard disk unit stores a computer program. Each of the apparatuses performs its functions by operation of a microprocessor according to the computer program. Here, the computer program includes a combination of instruction codes to indicate instructions to the computer so that the computer performs predetermined functions.

(2) All or part of the components of each of the devices may be composed of a system large scale integration (LSI). The system LSI is a super-multifunctional LSI manufactured by integrating constituent units on one chip, and is specifically a computer system including a microprocessor, ROM, and RAM. The ROM stores a computer program. The microprocessor loads the computer program from the ROM into the RAM and operates according to the loaded computer program so that the system LSI performs its functionality.

(3) All or part of the components of each of the devices may be composed of an IC card or a single-unit module attachable to the devices. Each of the IC card and the module is a computer system including components such as a microprocessor, a ROM, and a RAM. The IC card or the module may include the super-multi-functional LSI mentioned above. The microprocessor operates according to the computer program, so that the IC card or the module performs its functions. The IC card and the module may be tamper-resistant.

(4) The present invention may be implemented as a method described above. Furthermore, the present invention may be implemented as a computer program which causes a computer to execute the method or as a digital signal representing the computer program.

Furthermore, the present invention may be implemented as a computer program or a digital signal recorded on a computer-readable recording medium, such as a flexible disk, a hard disk, a CD-ROM, an MO, a DVD, a DVD-ROM, a DVD-RAM, a Blu-ray Disc (BD), a semiconductor memory, or the like. Furthermore, the present invention may be implemented as a digital signal recorded on any of these recording medium.

Furthermore, the present invention may be implemented as a computer program or a digital signal transmitted through an electric communication line, a wireless or wired communication line, a network typified by the Internet, data broadcasting, or the like.

Furthermore, the present invention may be implemented as a computer system including a microprocessor and memory, in which the memory stores a computer program and the microprocessor operates according to the computer program.

Furthermore, the program or the digital signal may be recorded on the recording medium and transmitted or may be transmitted via the network to be executed on a different independent computer system.

(5) The above embodiments and the variations may be selectively combined.

Although the embodiments of the present invention are described with reference to the drawings, the present invention is not limited to the embodiment shown in the drawings. Various modifications and variations of the embodiments shown in the drawings are covered by the present invention as long as they are the same as or equivalent to the present invention.

INDUSTRIAL APPLICABILITY

The howling suppression device according to the present invention is applicable to various sound devices having a microphone and a speaker and is useful as a howling suppression device which suppresses a howling sound generated by sound coupling between the speaker and the microphone.

REFERENCE SIGNS LIST

101, 901 microphone
102, 902 subtractor
103 sound processing unit
104 amplifier
105, 904 speaker
106, 905 delay unit
107, 906 adaptive filter
108 coefficient update control unit
201, 202, 301, 501, 801, 802 input terminal
203, 204, 502 level calculation unit
205 convergence analysis unit
206 change amount analysis unit
207, 403, 602 state determination unit
208, 701 update rate control unit
209, 303, 505, 806 output terminal
302 update rate selection unit
401 frequency analysis unit
402 peak detection unit
503 characteristics analysis unit
504 peak determination unit
601 audio detection unit
803 smoothing unit
804 update rate calculation unit
805 update rate setting unit
903 hearing-aid processor
907 autocorrelation calculation unit
908 threshold value evaluation unit
909 update control unit

The invention claimed is:

1. A howling suppression device which reduces a howling component included in an input signal, the howling suppression device comprising:

a subtractor which generates an error signal by subtracting, from the input signal, a pseudo feedback signal which is an estimated signal of a feedback signal that is the howling component included in the input signal;

an adaptive filter which generates a pseudo feedback signal for a next input signal by applying filtering to the error signal; and a coefficient update control unit configured to control an update rate of a filter coefficient of the adaptive filter, wherein the coefficient update control unit includes:

a convergence analysis unit configured to determine whether or not a first condition that a degree of convergence of filter characteristics of the adaptive filter with respect to spatial transfer characteristics is higher than a criterion value is satisfied, the filter characteristics being determined by the filter coefficient;

a change amount analysis unit configured to determine whether or not a second condition that the degree of convergence of the filter characteristics with respect to the spatial transfer characteristics has turned out to be higher than a predetermined period of time before is satisfied; and an update rate control unit configured to set the update rate to a first rate when both the first condition and the second condition are satisfied, and set the update rate to a second rate when at least one of the first condition or the second condition is not satisfied, the second rate being lower than the first rate, and the adaptive filter updates the filter coefficient for the application of the filtering to the error signal at the update rate set by the update rate control unit.

2. The howling suppression device according to claim 1, wherein the coefficient update control unit further includes:

a first level calculation unit configured to calculate a signal level of the input signal; and a second level calculation unit configured to calculate a signal level of the error signal, wherein when mean squared error between the signal level of the input signal and the signal level of the error signal is below a predetermined threshold value, the convergence analysis unit is configured to determine that the first condition is satisfied.

3. The howling suppression device according to claim 2, wherein when mean squared error between the signal level of the input signal and the signal level of the error signal shows a tendency to decrease in the predetermined period of time, the change amount analysis unit is configured to determine that the second condition is satisfied.

4. The howling suppression device according to claim 2, wherein when the first condition and the second condition are satisfied, the update rate control unit is configured to set the first rate at a higher level when the mean squared error between the signal level of the input signal and the signal level of the error signal has a smaller value.

5. The howling suppression device according to claim 2, wherein the coefficient update control unit further includes:

a frequency analysis unit configured to convert the signal level of the input signal into a frequency signal; and a peak detection unit configured to determine whether or not a third condition that the frequency signal has a peak is satisfied, and when all the first condition to the third condition are satisfied, the update rate control unit is configured to set the update rate to the first rate, and when at least one of the first condition, the second condition, or the third condition is not satisfied, the update rate control unit is configured to set the update rate to the second rate.

6. The howling suppression device according to claim 2, wherein the coefficient update control unit further includes an audio detection unit configured to determine whether or not a fourth condition that the signal level of the input signal has a maximum value above a predetermined value is satisfied, and when all the first condition, the second condition, and the fourth condition are satisfied, the update rate control unit is configured to set the update rate to the first rate, and when at least one of the first condition, the second condition, or the fourth condition is not satisfied, the update rate control unit is configured to set the update rate to the second rate.

7. The howling suppression device according to claim 2, wherein when the mean squared error remains below a predetermined threshold value for a predetermined period of time, the convergence analysis unit is configured to determine that the first condition is satisfied.

8. The howling suppression device according to claim 2, wherein the change amount analysis unit is configured to determine whether or not the second condition is satisfied, based on analysis of a slope value of the mean squared error plotted against time.

9. The howling suppression device according to claim 2, wherein the change amount analysis unit is configured to determine whether or not the second condition is satisfied, based on analysis of a difference between values of the mean squared error plotted against time.

10. A hearing aid comprising:

a sound pickup unit configured to pick up ambient sound and convert the ambient sound into the input signal;

the howling suppression device according to claim 1; and an output unit configured to convert the error signal generated by the subtractor into an output sound and output the output sound.

11. A howling suppression method for reducing a howling component included in an input signal, the howling suppression method comprising:

generating an error signal by subtracting, from the input signal, a pseudo feedback signal which is an estimated signal of a feedback signal that is the howling component included in the input signal;

generating a pseudo feedback signal for a next input signal by applying filtering to the error signal; and controlling an update rate of a filter coefficient for the generating of the pseudo feedback signal, wherein the controlling includes:

determining whether or not a first condition that a degree of convergence of filter characteristics of the adaptive filter with respect to spatial transfer characteristics is higher than a criterion value is satisfied, the filter characteristics being determined by the filter coefficient;

determine whether or not a second condition that the degree of convergence of the filter characteristics with respect to the spatial transfer characteristics has turned out to be higher than a predetermined period of time before is satisfied; and setting the update rate to a first rate when both the first condition and the second condition are satisfied, and setting the update rate to a second rate when at least one of the first condition or the second condition is not satisfied, the second rate being lower than the first rate, and in the generating of the pseudo feedback signal, the filter coefficient for the application of the filtering to the error signal is updated at the update rate set in the controlling.

12. An integrated circuit which reduces a howling component included in an input signal, the integrated circuit comprising:

a subtractor which generates an error signal by subtracting, from the input signal, a pseudo feedback signal which is an estimated signal of a feedback signal that is the howling component included in the input signal;

an adaptive filter which generates a pseudo feedback signal for a next input signal by applying filtering to the error signal; and a coefficient update control unit configured to control an update rate of a filter coefficient of the adaptive filter, wherein the coefficient update control unit includes:

a convergence analysis unit configured to determine whether or not a first condition that a degree of convergence of filter characteristics of the adaptive filter with respect to spatial transfer characteristics is higher than a criterion value is satisfied, the filter characteristics being determined by the filter coefficient;

a change amount analysis unit configured to determine whether or not a second condition that the degree of convergence of the filter characteristics with respect to the spatial transfer characteristics has turned out to be higher than a predetermined period of time before is satisfied; and an update rate control unit configured to set the update rate to a first rate when both the first condition and the second condition are satisfied, and set the update rate to a second rate when at least one of the first condition or the second condition is not satisfied, the second rate being lower than the first rate, and the adaptive filter updates the filter coefficient for the application of the filtering to the error signal at the update rate set by the update rate control unit.

* * * * *